US005409570A

United States Patent [19]

Griggs et al.

[11] Patent Number: 5,409,570

[45] Date of Patent: * Apr. 25, 1995

[54] PROCESS FOR OZONE BLEACHING OF OXYGEN DELIGNIFIED PULP WHILE CONVEYING THE PULP THROUGH A REACTION ZONE

[75] Inventors: Bruce F. Griggs, Columbia, S.C.; Thomas P. Gandek, Trenton, N.J.; Michael A. Pikulin, Bound Brook, N.J.; Allen Rosen, Lawrenceville, N.J.; Stuart T. Terrett, Elgin, S.C.; Spencer W. Eachus, Allentown; David E. White, Pennington, both of N.J.; William H. Friend, Savannah, Ga.; Omar F. Ali, Morrisville, Pa.

[73] Assignee: Union Camp Patent Holding, Inc., Wilmington, Del.

[ * ] Notice: The portion of the term of this patent subsequent to Jun. 8, 2010 has been disclaimed.

[21] Appl. No.: 981,467

[22] Filed: Nov. 25, 1992

Related U.S. Application Data

[63] Continuation-in-part of Ser. No. 896,481, Jun. 2, 1992, and Ser. No. 637,100, Jan. 3, 1991, Pat. No. 5,173,153, and Ser. No. 686,062, Apr. 16, 1991, Pat. No. 5,217,574, and Ser. No. 821,117, Jan. 15, 1992, and Ser. No. 939,408, Sep. 1, 1992, abandoned, which is a continuation of Ser. No. 637,081, Jan. 3, 1991, abandoned, said Ser. No. 821,117, is a continuation-in-part of Ser. No. 604,849, Oct. 26, 1990, Pat. No. 5,181,989, said Ser. No. 686,062, is a continuation-in-part of Ser. No. 489,845, Mar. 2, 1990, Pat. No. 5,085,734, said Ser. No. 637,100, is a continuation-in-part of Ser. No. 489,845, Mar. 2, 1990, which is a continuation of Ser. No. 311,669, Feb. 15, 1989, abandoned, said Ser. No. 896,481, is a continuation of Ser. No. 525,808, May 17, 1990, abandoned.

[51] Int. Cl.[6] ..... D21C 9/147; D21C 9/153; D21C 9/18

[52] U.S. Cl. ..... 162/40; 162/56; 162/57; 162/65; 162/90

[58] Field of Search ..... 162/57, 60, 65, 78, 162/29, 30, 30.1, 30.11, 88, 89, 76, 56, 5.19, 37, 72, 52, 237, 243, 90

[56] References Cited

U.S. PATENT DOCUMENTS 1,591,070 7/1926 Wolf .
1,642,978 9/1927 Thorne .
1,643,566 9/1927 Thorne .
1,818,913 8/1931 Van de Carr, Jr. .
1,860,432 5/1932 Richter .
(List continued on next page.)

FOREIGN PATENT DOCUMENTS

80441/91 8/1992 Australia .
(List continued on next page.)

OTHER PUBLICATIONS

Lindholm, "Effect of Pulp Consisteny and pH in Ozone Bleaching"; Paperija Puu, Feb. 1989, pp. 145–154.
(List continued on next page.)

*Primary Examiner*—Steve Alvo
*Attorney, Agent, or Firm*—Pennie & Edmonds

[57] ABSTRACT

A process for delignifying and bleaching a lignocellulosic pulp without the use of elemental chlorine or chlorine-containing compounds by oxygen delignifying the pulp to a K No. of about 14 or less and a viscosity of greater than about 10 cps and thereafter further delignifying the partially delignified pulp by lifting, displacing and tossing the pulp in a radial direction while advancing it in an axial direction in a plug flow-like manner with an effective amount of ozone for a sufficient time to obtain a substantially delignified pulp having a K No. of about 6 or less, a viscosity of at least about 7 cps and a GE brightness of at least about 35. The substantially delignified pulp may then be brightened to a final product having a GE brightness of at least about 75, or alternately up to about 83 or more by contacting the ozonated pulp with chlorine dioxide or a peroxide compound. Because of the absence of elemental chlorine in this sequence, filtrate from all stages but the chlorine dioxide stage (if used) can be recovered without sewering. Major environmental improvements are thus achieved.

22 Claims, 4 Drawing Sheets

U.S. PATENT DOCUMENTS

| | | | |
|---|---|---|---|
| 1,957,937 | 5/1934 | Campbell et al. . | |
| 2,013,115 | 9/1935 | Thorne | 8/2 |
| 2,431,478 | 11/1947 | Hill | 8/156 |
| 2,466,633 | 4/1949 | Brabender et al. . | |
| 2,926,114 | 2/1960 | Grangaard et al. . | |
| 2,975,169 | 3/1961 | Cranford et al. . | |
| 3,024,158 | 3/1962 | Grangaard et al. . | |
| 3,251,730 | 5/1966 | Watanabe . | |
| 3,274,049 | 9/1966 | Gaschke et al. . | |
| 3,318,657 | 5/1967 | Wade | 8/111 |
| 3,384,533 | 5/1968 | Meylan et al. . | |
| 3,423,282 | 1/1969 | Rerolle et al. . | |
| 3,451,888 | 6/1969 | Ancelle et al. | 162/65 |
| 3,462,344 | 8/1969 | Kindron et al. . | |
| 3,630,828 | 12/1971 | Liebergott et al. | 162/24 |
| 3,652,388 | 3/1972 | Croon et al. | 162/65 |
| 3,660,225 | 6/1972 | Verreyne et al. | 162/17 |
| 3,663,357 | 5/1972 | Liebergott | 162/65 |
| 3,703,425 | 11/1972 | Schlenofer | 162/17 |
| 3,725,193 | 6/1973 | De Montigny | 162/17 |
| 3,740,310 | 6/1973 | Smith et al. | 162/65 |
| 3,759,783 | 9/1973 | Samuelson et al. | 162/40 |
| 3,785,577 | 1/1974 | Carlsmith | 241/57 |
| 3,814,664 | 6/1974 | Carlsmith | 162/236 |
| 3,832,276 | 8/1974 | Roymoulik et al. | 162/65 |
| 3,874,992 | 4/1975 | Liebergott | 162/66 |
| 3,888,727 | 6/1975 | Kenig | 162/65 |
| 3,926,798 | 12/1975 | Cadotte | 210/23 |
| 3,951,733 | 5/1976 | Phillips | 162/65 |
| 3,962,029 | 6/1976 | Wettermark et al. | 162/49 |
| 3,964,962 | 6/1976 | Carlsmith | 162/236 |
| 4,046,621 | 9/1977 | Sexton | 162/40 |
| 4,080,249 | 3/1978 | Kempf et al. | 162/57 |
| 4,089,737 | 5/1978 | Nagano et al. | 162/19 |
| 4,093,506 | 6/1978 | Richter | 162/17 |
| 4,119,486 | 10/1978 | Eckert | 162/65 |
| 4,120,747 | 10/1978 | Sarge, III et al. | 162/117 |
| 4,123,317 | 10/1978 | Fritzvold et al. | 162/17 |
| 4,155,806 | 5/1979 | Mannbro | 162/19 |
| 4,155,845 | 5/1979 | Ancelle et al. | 210/22 R |
| 4,158,597 | 6/1979 | Petersson | 162/238 |
| 4,198,266 | 4/1980 | Kirk et al. | 162/29 |
| 4,216,054 | 8/1980 | Bentvelzen et al. | 162/57 |
| 4,220,498 | 9/1980 | Prough | 162/25 |
| 4,226,673 | 10/1980 | Fremont | 162/29 |
| 4,229,252 | 10/1980 | Meredith | 162/65 |
| 4,248,662 | 2/1981 | Wallick | 162/19 |
| 4,259,150 | 3/1981 | Prough | 3/81 |
| 4,268,350 | 5/1981 | Mansson | 162/29 |
| 4,272,918 | 6/1981 | Zilka | 162/237 |
| 4,274,913 | 6/1981 | Kikuiri et al. | 162/65 |
| 4,278,496 | 7/1981 | Fritzvold | 162/19 |
| 4,279,694 | 7/1981 | Fritzvold et al. | 162/28 |
| 4,283,251 | 8/1981 | Singh | 162/17 |
| 4,295,925 | 10/1981 | Bentvelzen et al. | 162/19 |
| 4,295,926 | 10/1981 | Bentvelzen et al. | 162/57 |
| 4,298,426 | 11/1981 | Torregrossa | 162/57 |
| 4,298,427 | 11/1981 | Bentvelzen et al. | 162/57 |
| 4,363,697 | 12/1982 | Markham et al. | 162/19 |
| 4,372,812 | 2/1983 | Phillips | 162/40 |
| 4,384,920 | 5/1983 | Markham et al. | 162/19 |
| 4,426,256 | 1/1984 | Johnsen | 162/237 |
| 4,431,480 | 2/1984 | Markham et al. | 162/19 |
| 4,435,249 | 3/1984 | Markham et al. | 162/24 |
| 4,439,271 | 3/1984 | Samuelson | 162/19 |

(List continued on next page.)

FOREIGN PATENT DOCUMENTS

| | | |
|---|---|---|
| 966604 | 4/1975 | Canada . |
| 970111 | 7/1975 | Canada . |
| 1103409 | 6/1981 | Canada . |
| 1112813 | 11/1981 | Canada . |
| 1119360 | 3/1982 | Canada . |
| 1132760 | 10/1982 | Canada . |
| 1154205 | 9/1983 | Canada . |
| 1181204 | 1/1985 | Canada . |
| 1186105 | 4/1985 | Canada . |

(List continued on next page.)

OTHER PUBLICATIONS

Abrahanson and Samuelson, "Oxygen/Sodium Carbonate Bleaching of Kraft Pulp Pretreated with Nitrogen Dioxide and Oxygen", Svensk Papperstidning (1983).

Allison, R. W., "Efficient Ozone and Peroxide Bleaching of Alkaline Pulps From Pinus Radiata," *Appita,* vol. 36, No. 1 (Jul. 1992) p. 42.

Article, "Naco Straw Pulp", PPI, (Apr. 1987).

Agrawal et al., "Performance of Trough–Paddle Mixing Conveying System for Treatment of Wheat Straw with Small Volumes of Liquids," p. 18.

Allison, R. W., "Effect of Ozone on High–Temperature Thermomechanical Pulp", *Appita,* vol. 32, No. 4 (Jan. 1979) p. 279.

Allison, Production of Bleached Softwood Pulp by Low Pollution Processes, Wood Sci. Technol. 17, pp. 129–137 (1983).

Andtbacka, "Low Kappa Pulping Followed by Oxygen Delignification", Appita, vol. 39, No. 2, (1986).

(List continued on next page.)

U.S. PATENT DOCUMENTS

| | | | |
|---|---|---|---|
| 4,444,621 | 4/1984 | Lindhal | 162/26 |
| 4,450,044 | 5/1984 | Fritzvold et al. | 162/65 |
| 4,451,332 | 5/1984 | Annergren et al. | 162/30.1 |
| 4,459,174 | 7/1984 | Papageorges et al. | 162/40 |
| 4,468,286 | 8/1984 | Johnsen | 162/17 |
| 4,563,243 | 1/1986 | Koch et al. | 162/18 |
| 4,568,420 | 2/1986 | Nommi | 162/65 |
| 4,595,455 | 6/1986 | Mannbro | 162/38 |
| 4,640,782 | 2/1987 | Burleson | 210/748 |
| 4,818,339 | 4/1989 | Lamort | 162/4 |
| 4,834,837 | 5/1989 | Loqenz | 162/56 |
| 4,840,703 | 6/1989 | Malmsten | 162/49 |
| 5,039,314 | 8/1991 | Lehne et al. | 55/26 |
| 5,164,044 | 11/1992 | Griggs et al. | 162/60 |

FOREIGN PATENT DOCUMENTS

| | | | |
|---|---|---|---|
| 2067844 | 3/1992 | Canada . | |
| 062539 | 10/1982 | European Pat. Off. . | |
| 106460 | 4/1984 | European Pat. Off. . | |
| 106609 | 4/1984 | European Pat. Off. . | |
| 276608 | 8/1988 | European Pat. Off. . | |
| 0308314 | 3/1989 | European Pat. Off. . | |
| 0402335 | 12/1990 | European Pat. Off. . | |
| 0492039A1 | 7/1992 | European Pat. Off. . | |
| 0492040A1 | 7/1992 | European Pat. Off. . | |
| 0512590A1 | 11/1992 | European Pat. Off. . | |
| 0520140A1 | 12/1992 | European Pat. Off. . | |
| WO88/03095 | 7/1988 | WIPO . | |
| WO91/18145 | 11/1991 | WIPO | 162/65 |

OTHER PUBLICATIONS

Backlund, A., "A Progress Report on Continuous Digester Development", Paper Presented to the 21st EUCEPA International Conference—Torremolinos, Spain.

Balousck, "The Effects of Ozone Upon Lignin Model Containing the B-aryl Ether Linkage", Svensk Papperstidning, No. 9, 1981.

Brannland and Fossin, "How to Cope with TOCL", International Oxygen Delignification Conference, (1987).

Britt, "Pulp and Paper Technology".

Casey, J. P., "Bleaching: A Perspective", *TAPPI Journal,* vol. 66, No. 7 (Jul. 1983) p. 95.

Carlberg et al., "Bleaching of Sulphite and Sulphate Pulps Using Conventional and Unconventional Sequences", TAPPI Proceedings 1982 Annual Meeting, p. 381.

Chapter 6—Sulfite Pulping, Handbook of Pulp & Paper Technologists (TAPPI).

Chapter 7—Kraft Pulping, Handbook for Pulp & Paper Technologists (TAPPI).

Chapter 11—Bleachng, Handbook for Pulp & Paper Technologists (TAPPI).

Christenson, P. K., Bleaching of Sulphate Pulps with Hydrogen Peroxide: III. Bleaching of Oxygen Bleached Pulps, *Norsk Skogindustri* (Oct. 1973) p. 268.

DeSousa et al., "The Influence of Chlorine Ratio and Oxygen Bleaching on the Formation of PCDF's and PCCD's in Pulp Bleaching", Tappi Journal (Apr. 1989).

Dyck, A. W. J., "New Advances in Mechanical Pulping", *American Paper Industry* (Sep. 1971) p. 21.

Eickeler, "Ozone Measurement with Detector Tubes".

Elton et al., "New Technology for MediumConsistency Oxygen Bleaching".

Eriksson and Gierer, "Ozonation of Residual Lignin".

Fossum et al., "Final Bleaching of Kraft Pulps Delignified to Low Kappa Number by Oxygen Bleaching", Tappi Journal pp. 60–62 (Dec. 1983).

Fujii et al., "Oxygen Pulping of Hardwoods, TAPPI Alkaline Pulping/Secondary Fibers Conference (Washington, D.C., Nov. 7–10, 1977).

Gangolli, "The Use of Ozone and Pulp in the Paper Industry".

Geiger, "Mechanisms of Bleach with Oxygen Containing Species", ISWPC, (1987).

Gellerstedt et al., "Singlet Oxygen Oxidation of Lignin Structures," *Singlet Oxygen,* Chapter 31, pp. 302–310, (Sep. 1976).

Germgard, "Chlorate Discharge from Bleach Plants—How to Handle a Potential Environmental Problem", Paperi ja Puu, vol. 71, No. 3, (1989).

Germgard et al., "Mathematical Models for Simulation and Control of Bleaching Stages," Nordic PUlp and Paper Research Journal, NO. 1 (1987).

Germgard and Sjogren, "Ozone Prebleaching of a Modified-Cooked and Oxygen-Bleached Softwood Kraft Pulp", Svensk Papperstidning, No. 15, (1985).

Gierer, "Chemistry of Delignification, Part 2: Reactions of Lignins During Bleaching", World Science and Technology (1986).

Godsay and Pearce, "Physico-Chemical Properties of Ozone Oxidized Kraft Pulps", Oxygen Delignification (1984).

Grant, R. S., Displacement Heating Trails with a New Process to Reduce Steam, *TAPPI Journal* (Mar. 1983) p. 120.

(List continued on next page.)

OTHER PUBLICATIONS

Gregor and Gregor, "Synthetic—Membrane Technology", Scientific American, (Jul. 1978).
Gupta, et al., OZ Prebleaching, Influence on Viscosity and Sheet Strength, TAPPI Symposium-Oxygen Delignificatioin, p. 1 (1984).
Heimburger et al., Kraft Mill Bleach Plant Effluents: Recent Developments Aimed at Decreasing Their Environmental Impact.
Heimburger et al., Kraft Mill Bleach Plant Effluents: Recent Developments Aimed at Decreasing Their Environmental Impact, Part, II, TAPPI Journal, p. 69 (Nov. 1988).
Hill and Rice, "Handbook of Ozone Technology and Applications", Ann Arbor Science.
Hiraoka et al., "Two Dimensional Model Analysis of Turbulent Flow Behavior of Highly Viscous Non--Newtonian Fluid in Agitated Vessel with Paddle Impeller," Journal of Chemical Eng. of Japan, p. 56.
Hiraoka et al., "Two Dimensional Model Analysis of Turbulent Flow in an Agitated Vessel With Paddle Impeller, Chem. Eng. Commun., p. 149.
Jamieson and Smedman, "Integration of Oxygen Bleaching in the Brown Stock Washing System", Svensk Papperstidning (1973).
Katai and Schuerch, "Mechanism of Ozone Attack on Alpha-Methyl Glucoside and Cellulosic Materials".
Kortelainen, V. A. et al., Experiences with Extended Delignification of Hardwood and Softwood Kraft Pulp in a Continuous Digester, *TAPPI Journal,* (Nov. 1985) p. 70.
Kratzl et al., "Reactions of Lignin and Lignin Model Compounds With Ozone", *Tappi,* vol. 59, No. 11 (Nov. 1976) p. 86.
Kirk et al., "Low Consistency Oxygen Delignification in a Pipeline Reactor," TAPPI, vol. 61, No. 5.
Kibblewhite et al., "Effects of Ozone on the Fibre Characterisitics of High-Temperature Thermomechanical Pulp", Proceedings of the 1979 International Mechanical Pulping Conference, p. 293.
Klein, et al., Delignifying Bleaching of Sulfite Pulps with Hydrogen Peroxide, EUCEPA Conference Report (Jun. 1980).
Leopold, B., "The Pulping Process—Opportunity or Headache?", Proceedings of IPC Conference, Paper Science and Technology, May 8-10, 1979.
Leopold, B., "The Pulp Mill of the Future", *Textile and Paper Chemistry and Technology,* p. 239.
Liebergott et al., "The use of Ozone or Oxygen in the First Bleaching Stage", *Ozone: Science and Engineering,* vol. 4, pp. 109 (1982).
Liebergott, N., "Paprizone Process for Brightening and Strengthening Groundwood", *Paper Trade Journal* (Aug. 2, 1971) p. 28.
Liebergott, N., Technical Paper T214—"Sequential Treatment of Mechanical Pulps at High Consistency with $H_2O_2$ and $O_3$—The Paprizone Process-Effect on Pulp Brightness and Strength", *Pulp and Paper Magazine of Canada,* vol. 73, No. 9, (Sep. 1972) p. 70.
Liebergott, et al., Bleaching a Softwood Kraft Pulp Without Chlorine Compounds, pp. 1-10.
Liebergott et al., "Ozone Delignification of Bleach Spruce and Hardwood Kraft, Kraft Anthrquinone, and Soda-Anthrquinone", *TAPPI,* vol. 64, No. 6 (Jun. 1981) p. 95.
Liebergott et al., "Comparison Between Oxygen and Ozone Delignification in the Bleaching of Kraft Pulps", TAPPI Proceedings—Pulping Conference, p. 157.
Liebergott et al., "The Use of Ozone in Bleaching and Brightening Wood Pulps: Part 1—Chemical Pulps (TAPPI 1978).
Lindholm, "Effect of Heterogeneity in Pulp Bleaching With Ozone", Paperi ja Puu, (Apr. 1987).
Lindholm, "Effect of Pulp Consistency and pH in Ozone Bleaching", Paperi ja Puu, (Mar. 1987).
Lindholm, "Effect of Pulp Consistency of pH in Ozone Bleaching Part 2", International Oxygen Delignification Conference (1987).
Lindquist, et al., "Ozone Bleaching of Sulfite Pulps", TAPPI Proceedings of the 1982 International Sulfite Pulping Conference, p. 127.
Loras et al., "Bleaching of Sulphite Pulps With Oxygen and Ozone", Report of 1982 International Pulp Bleaching Conference, p. 45.
Loras, V., "Bleachability of Mechanical Pulp", *Tappi,* vol. 57, No. 2 (Feb. 1974) p. 98.
Mbachu et al., "The Effect of Acetic and Formic Acid Pretreatment on Pulp Bleaching With Ozone", *TAPPI,* vol. 64, No. 1 (Jan. 1981) p. 67.
McDonough, "Oxygen Bleaching's Pace Quickens", IPC Technical Paper Series, No. 246 (Jul. 1987).
Melnyk et al., "An Ozone Reactor for Color Removal (List continued on next page.)

OTHER PUBLICATIONS

From Pulp Bleachery Wastes," Chemical Abstracts, p. 434.
Meredith et al., "Ozone Mass Transfer Agitated Low Consistency," Wood Pulp, Sep. 9, 1981.
Norden and Simonson, "Ozone Bleaching of Sulphite Pulp—A Pilot Plant Study".
Ohnishi, K., "Japan: Pulping, Bleaching", *Pulp and Paper* (Aug. 1978) p. 88.
Ouederni, "Simulation of the Ozone/Lignin Reaction in an Agitated Vessel".
Ow, et al., Advances in Ozone Bleaching: Part II—-Bleaching of Softwood Kraft Pulps with Oxygen and Ozone Combination, TAPPI Symposium—Oxygen Delignification (1984).
Ozone Bleaching of Sulfite Pulps", *Svensk Papperstidning* (Nov. 6, 1984) p. 54.
Ozone Bleaching Has Potential For Closing Pulp Mill Water Systems", *Pulp & Paper* (Jul. 1978) p. 76.
Patridge, H., "An Overview of New Pulp Bleaching Developements" AIChE National Meeting, Paper No. 24a (Sep. 7–10, 1975).
Patridge, H., "New Pulp Bleaching Developments", *CEP* (Jun. 1976).
Patt, et al., Use of Ozone For Pulp Bleaching, Papier, 42 (10A), vol. 14–23 (1988).
Perkins et al., Advances in Ozone Bleaching—Part III—Pilot Plant Installations and Proposed Commercial Implementation.
Pettersson, B. et al., Advances in Technology Make Batch Pulping as Efficient as Continuous, *Pulp and Paper* (Nov. 1985) p. 90.
Pilot Scale Research at PFI", *Norsk Skogindustri,* (Oct. 1980) p. 228.
Procter, A. R., "Ozone for Treatment of High Kappa Kraft Pulps", *Pulp and Paper Magazine of Canada,* vol. 75, No. 6 (Jun. 1974) p. 58.
Reeve and Earl, "Chlorinated Organic Matter in Bleached Chemical Pulp Production Part I: Environmental Impact and Regulations of Effluents, Pulp and Paper Canda", 90:4 (1989).
Rothenberg, S., et al., Bleaching of Oxygen Pulps with Ozone, *TAPPI Journal* (Aug. 1975) p. 182.
Rothenberg et al., "Ozone Bleaching of Oxygen Pulp", Proceedings of the 1982 Pulping Conference, p. 341.
Rothenberg et al., "Bleaching of Oxygen Pulps with Ozone," TAPPI Journal (Aug. 1975), p. 175.
Rutkowski et al., "Investigations on Bleaching of Sulphate Pine Pulp With Ozone", *Cellulose Chem. Technol.,* vol. 18, (1984) p. 323.
Sarkanen, et al., Chlorination-Free Doxy Bleaching Process for Kraft Pulps.
Saul, C. M., "Chemical Pulp: Its Status and Future", *Appita,* vol. 32, No. 5 (Mar. 1979) p. 345.
Schuerch, "Ozonization of Cellulose and Wood", Journal of Polymer Science, No. 2 (1963).
Secrist et al., "Kraft Pulp Bleaching. II. Studies on the Ozonation of Chemical Pulps", *TAPPI,* vol. 54, No. 4 (Apr. 1971) p. 581.
Secrist et al., "Studies on the Ozonation of Chemical Pulps," p. 215.
Seifert et al., "Engineering Considerations in the Design of Oxygen Reactors," p. 309.
Singh, "The Bleaching of Pulp," TAPPI Press, 3rd Edition.
Singh, Advances in Ozone Bleaching—Part I: The Ozone Bleaching Process—Laboratory to Pilot Plant.
Singh, Ozone Replaces Chlorine in the First Bleaching Stage: Advances in Ozone Bleaching—Part 1, TAPPI Journal, p. 45 (Feb. 1982).
Soteland, N., Bleaching of Chemical Pulps with Oxygen and Ozone, *Norsk Skogindustri* (Sep. 1978) p. 199.
Soteland, N., "Bleaching of Chemical Pulps With Oxygen and Ozone", Pulp and Paper Magazine of Canada, vol. 75, No. 4 (Apr., 1974), p. 91.
Soteland, N. "The Effect of Ozone on Mechanical Pulps", *Pulp and Paper Magazine of Canada,* vol. 78, No. 7 (Jul. 1977) p. 45.
Soteland, N., "The Effect of Ozone on Mechanical Pulps", Extended Abstracts of 1976 Canadian Wood Chemistry Symposium, p. 13.
Soteland, Comparison Between Oxygen and Ozone Delignification of Sulphite Pulps, TAPPI Symposium-Oxygen Delignification, p. 71 (1984).
Talka and Priha, "Fractionation and Identification of Some Biologically Active Compounds in Bleached Kraft Mill Effluents, Paperi ja Puu (1987).
Tenda et al., "Mixing Characteristics and Optimum Conditions of a Horizontal Gas-Solid Agitated Vessel With Paddle-Blades on Double Parallel Axes," Kogaku, pp. 1–15.
Tritschler and Shelton, "Commerical Manufacture and Industrial Use of Ozone and an Oxidant".
Vidal and Molinier, "Ozonolysis of Lignin-Improvement of In Vitro Digestibility of Poplar Sawdust", Biomass 16, (1988).
Voss et al., "Some New Insights Into the Origins of Dioxins Formed During Chemical Pulp Bleaching", Pulp and Paper Canada, 89:12 (1988).
Winardi et al., "Pattern Recognition in Flow Visualization Around a Paddle Impeller," Journal of Chemical Engineering of Japan, pp. 503–508.
Wong et al., "Toxicity, BOD and Color of Effluents From Novel Bleaching Processes", *Pulp and Paper Magazine of Canada,* vol. 79, No. 7 (Jul. 1978) p. 41.

PROCESS FOR OZONE BLEACHING OF OXYGEN DELIGNIFIED PULP WHILE CONVEYING THE PULP THROUGH A REACTION ZONE

CROSS REFERENCE TO RELATED APPLICATIONS

This application is (1) a continuation-in-part of application Ser. No. 07/896,481 filed Jun. 2, 1992, which is a continuation of application Ser. No. 07/525,808 filed May 17, 1990, now abandoned; (2) a continuation-in-part of applications Ser. No. 07/637,100 filed Jan. 3, 1991, U.S. Pat. No. 5.,173,153 and Ser. No. 07/686,062 filed Apr. 16, 1991, U.S. Pat. No. 5,217,574, each of which is a continuation-in-part of application Ser. No. 07/489,845 filed Mar. 2, 1990, U.S. Pat. No. 5,085,734, which is a continuation of application Ser. No. 07/311,669, filed Feb. 15, 1989, now abandoned; (3) a continuation-in-part of application Ser. No. 07/821,117 filed Jan. 15, 1992, which is a continuation-in-part of application Ser. No. 07/604,849 filed Oct. 26, 1990, U.S. Pat. No. 5,181,989; and (4) a continuation-in-part of application Ser. No. 07/939,408 filed Sep. 1, 1992, now abandoned, which is a continuation of application Ser. No. 07/637,081 filed Jan. 3, 1991, now abandoned.

FIELD OF THE INVENTION

This invention relates to a novel, environmentally acceptable process for delignifying and bleaching lignocellulosic pulp which does not require the use of elemental chlorine and which produces a pulp of acceptable strength. Use of this process also reduces the amount of environmental pollutants.

BACKGROUND OF THE INVENTION

Wood is comprised of two main components—a fibrous carbohydrate, i.e., cellulosic portion, and a non-fibrous component. The polymeric chains forming the fibrous cellulose portion of the wood are aligned with one another and form strong associated bonds with adjacent chains. The non-fibrous portion of the wood comprises a three-dimensional polymeric material formed primarily of phenylpropane units, known as lignin. Part of the lignin is between the cellulosic fibers, bonding them into a solid mass, although a substantial portion of the lignin is also distributed within the fibers themselves.

For use in paper-making processes, wood must first be reduced to pulp. Pulp may be defined as wood fibers capable of being slurried or suspended and then deposited upon a screen to form a sheet, i.e., of paper. The methods employed to accomplish the pulping step usually involve either physical or chemical treatment of the wood, or a combination of these two treatments, to alter the wood's chemical form and to impart desired properties to the resultant product. There are thus two main types of pulping techniques, i.e., mechanical pulping and chemical pulping. In mechanical pulping, the wood is physically separated into individual fibers. In chemical pulping, the wood chips are digested with chemical solutions to solubilize a portion of the lignin and thus permit its removal. The commonly utilized chemical pulping processes are broadly classified as: (1) the soda process, (2) the sulfite process, and (3) the Kraft process, with the latter process being most commonly used and being capable of a variety of well-known modifications as described below.

The soda process is well known in the art. It employs sodium hydroxide (NaOH) as the active reagent to break down the lignin and to assist in its removal. The sulfite process is also well known in the art (see, e.g., Handbook for Pulp & Paper Technologists—Chapter 6: Sulfite Pulping (TAPPI, U.S.A.).

The Kraft process together with its numerous variations is the principle chemical process utilized in paper manufacturing. The basic Kraft process, as described in the Handbook For Pulp and Paper Technologists—Chapter 7: Kraft Pulping (TAPPI, U.S.A.), involves digesting the wood chips in an aqueous solution of sodium hydroxide (NaOH) and sodium sulfide ($Na_2S$). This process is highly effective in the pulping of even difficult woods such as southern softwoods, as well as the other more readily pulped species of wood such as northern hardwoods and softwoods. The Kraft process likewise generally produces a relatively high-strength pulp since its use results in a diminished attack on the cellulose component of the wood.

The modified Kraft techniques can result in even less degradation in the polymeric structure of the cellulosic fibers during pulping and therefore the strength loss in the resultant paper product is diminished as compared to that occurring with the standard Kraft process. One modified Kraft pulping process is known as "extended delignification", which is a broad term used in the art to encompass a variety of modified Kraft techniques, such as adding the pulping chemicals in a specific defined sequence, or at different locations within the digester apparatus, or at different time periods, or with a removal and reinjection of cooling liquors in a prescribed sequence, so as to more effectively remove a greater amount of lignin while reducing the severity of the pulping liquor's chemical attack on the cellulosic fibers. Another modification of the Kraft process is the Kraft-AQ process, wherein a small amount of anthraquinone is added to the Kraft pulping liquor to accelerate delignification while limiting the attack upon the cellulosic fibers which comprise the wood.

A variety of additional extended delignification techniques are known in the art and include Kamyr Modified Continuous Cooking (MCC) as described by V.A. Kortelainen and E. A. Backlund in TAPPI, vol. 68 (11), 70 (1985); Beloit Rapid Displacement Heating (RDH) as reported by R. S. Grant in TAPPI, vol. 66 (3), 120 (1983); and Sunds Cold Blow Cooking as reported by B. Pettersson and B. Ernerfeldt in Pulp and Paper, vol. 59 (11) 90 (1985).

Digestion of the wood by a Kraft or modified Kraft process results in the formation of a dark colored slurry of cellulose fibers known as "brownstock". The dark color of the brownstock is attributable to the fact that not all of the lignin has been removed during digestion and has been chemically modified in pulping to form chromophoric groups. Thus, in order to lighten the color of the brownstock pulp, i.e., to make it suitable for use as printing and writing and other white paper applications, it is necessary to continue the removal of the remaining lignin by the addition of delignifying materials and by chemically converting any residual lignin into colorless compounds by a process known as "bleaching" or "brightening".

Prior to bleaching the pulp, however, the digested material is conventionally transferred to a separate blow tank after the chemical treatments involved in the pulping process are completed. Within the blow tank, the pressure developed during the initial chemical treatment of the lignocellulosic material is relieved and the pulp material is separated into a fibrous mass. The resulting fibrous mass is then subjected to a series of washing steps to remove the combination of any residual chemicals and the soluble materials (such as the lignin) which were separated from the fibrous materials in the pulping process. Frequently, the pulp also undergoes one or more screening steps designed to separate out the larger portions of undefibered wood for special processing (recooking, mechanical grinding, etc.).

The residue obtained from the washing process, commonly referred to as black liquor, is collected, concentrated, and then incinerated in an environmentally safe manner in a recovery boiler. The technique for the collection, concentration and burning of the black liquor is conventional and is well known in the art.

The delignification and bleaching processes are conducted on the washed fibrous mass in a series of steps, using selected combinations of chemical reactants. In the prior art, various combinations of chemical treatments have been suggested. Furthermore, individual treatment steps have been rearranged in an almost limitless number of combinations and permutations. Therefore, in order to simplify the explanation of the various bleaching processes and systems, the use of letter codes is conventionally employed in combination to describe the particular chemical reactants employed and the sequence of the steps of the process.

The letter codes which will be used hereafter, where appropriate, are as follows:

C=Chlorination—Reaction with elemental chlorine in acidic medium.

E=Alkaline Extraction—Dissolution of reaction products with NaOH.

Oxidative Alkaline Extraction—Dissolution of reaction products with NaOH and Oxygen.

D=Chlorine Dioxide—Reaction with $ClO_2$ in acidic medium.

P=Peroxide—Reaction with peroxides in alkaline medium.

O=Oxygen—Reaction with elemental oxygen in alkaline medium.

$O_m$=Modified Oxygen—Uniform alkali treatment of low to medium consistency pulp followed by reaction of high consistency pulp with oxygen.

Z=Ozone—Reaction with ozone.

$Z_m$=Modified Ozone—Uniform reaction with ozone.

C/D—Admixtures of chlorine and chlorine dioxide.

H=Hypochlorite—Reaction with hypochlorite in an alkaline solution.

$O_m$ and $Z_m$ are modified processes according to the present invention and are described further in the

DETAILED EESCRIPTION OF THE INVENTION

It has been conventional for many years to delignify and bleach wood pulp by using elemental chlorine. Exemplifying the bleaching of lignocellulosic pulps are the processes disclosed in, for example, U.S. Pat. No. 1,957,937 to Campbell et al., U.S. Pat. No. 2,975,169 to Cranford et al. and, U.S. Pat. No. 3,462,344 to Kindron et al.; and Handbook For Pulp and Paper Technologists—Chapter 11: Bleaching (§11.3) (TAPPI, USA).

However, although elemental chlorine has proven to be an effective bleaching agent, it is difficult to handle and potentially hazardous to both mill personnel and equipment. For example, the effluents from chlorine bleaching processes contain large amounts of chlorides produced as the by-product of these processes. These chlorides readily corrode processing equipment, thus requiring use of costly materials in the construction of such mills. Further, the build-up of chlorides within the mill precludes recycling the washer filtrate after a chlorination stage in a closed system operation without employing recovery systems requiring extensive, and therefore expensive, modifications. In addition, concern about the potential environmental effects of chlorinated organics in effluents, which the U.S. Environmental Protection Agency believes to be toxic to humans and animals, has caused significant changes in government requirements and permits for bleach mills which include standards that may be impossible to meet with conventional bleaching or pollution control technology.

To avoid these disadvantages, the paper industry has attempted to reduce or eliminate the use of elemental chlorine and chlorine-containing compounds from multi-stage bleaching processes for lignocellulosic pulps. Complicating these efforts is the requirement that high levels of pulp brightness are required for many of the applications for which such pulp is to be used.

In this connection, efforts have been made to develop a bleaching process in which chlorine-containing agents are replaced, for example, by oxygen for the purpose of bleaching the pulp. The use of oxygen does permit the recycling of effluent from this stage for recovery and does permit a substantial reduction in the amount of elemental chlorine used. A number of processes for bleaching and delignifying pulp with oxygen have been proposed, such as Richter U.S. Pat. No. 1,860,432, Grangaard et al. U.S. Pat. Nos. 2,926,114 and 3,024,158, Gaschke et al. U.S. Pat. No. 3,274,049, Meylan et al. U.S. Pat. No. 3,384,533, Watanabe U.S. Pat. No. 3,251,730, Rerolle et al. U.S. Pat. No. 3,423,282, Farley U.S. Pat. No. 3,661,699, Kooi U.S. Pat. No. 4,619,733 and P. Christensen in "Bleaching of Sulphate Pulps with Hydrogen Peroxide" Norsk Skogindustri, 268–271 (1973). Alkaline pretreatments of pulp prior to oxygen delignification are suggested by U.S. Pat. No. 4,806,203 to Elton.

The use of oxygen, however, is not a completely satisfactory solution to the problems encountered with elemental chlorine. Oxygen is not as selective a delignification agent as elemental chlorine, and the K No. of the pulp, using conventional oxygen delignification methods, can be reduced only a limited amount until there is a disproportionate, i.e., unacceptable, attack on the cellulosic fibers. Also, after oxygen delignification, the remaining lignin has heretofore typically been removed by chlorine bleaching methods to obtain a fully-bleached pulp, but using much reduced amounts of chlorine. However, even at such reduced chlorine concentrations, the corrosive chlorides would soon reach unacceptable concentration levels in a closed cycle operation.

To avoid the use of chlorine bleaching agents, the removal of such remaining lignin with the use of ozone in the bleaching of chemical pulp has previously been attempted. Although ozone may initially appear to be an ideal material for bleaching lignocellulosic materials, the exceptional oxidative properties of ozone and its relative high cost have heretofore limited the development of satisfactory ozone bleaching processes for lignocellulosic materials, especially southern softwoods. Ozone will readily react with lignin to effectively reduce the K No., but it will also, under most conditions, aggressively attack the carbohydrate which comprises the cellulosic fibers and substantially reduce the strength of the resulting pulp. Ozone, likewise, is extremely sensitive to process conditions such as pH with respect to its oxidative and chemical stability, and such changes can significantly alter the reactivity of ozone with respect to the lignocellulosic materials.

Since around the turn of the century, when the delignifying capabilities of ozone were first recognized, there has been substantial and continuous work by numerous persons in the field to develop a commercially suitable method using ozone in the bleaching of lignocellulosic materials. Furthermore, numerous articles and patents have been issued in this area and there have been reports of attempts at conducting ozone bleaching on a non-commercial pilot scale basis. For example, U.S. Pat. No. 2,466,633 to Brabender et al., describes a bleaching process wherein ozone is passed through a pulp having a moisture content (adjusted to an oven dry consistency) of between 25 and 55 per cent and a pH adjusted to the range of 4 to 7.

Other non-chlorine bleach sequences are described by S. Rothenberg, D. Robinson & D. Johnsonbaugh, "Bleaching of Oxygen Pulps with Ozone" Tappi 182–185 (1975)—Z, ZEZ, ZP and ZPa(Pa-peroxyacetic acid); and N. Soteland, "Bleaching of Chemical Pulps With Oxygen and Ozone" Pulp and Paper Magazine of Canada; T153–58 (1974)—OZEP, OP and ZP.

Also, U.S. Pat. No. 4,196,043 to Singh discloses a multi-stage bleaching process which also attempts to eliminate the use of chlorine compounds, and includes examples specifically directed to hardwoods. It is well known to those skilled in the art that hardwoods are easier to bleach than most softwoods. This process is characterized by from one to three ozone bleaching stages and a final treatment with alkaline hydrogen peroxide, each stage being separated by an alkaline extraction. One such sequence may be described in the common shorthand nomenclature of the paper industry as ZEZEP. In accordance with this process, the effluent from each treatment stage may be collected and recycled for use in bleaching operations, preferably at an earlier stage than that from which it was obtained. This patent also provides a so-called countercurrent effluent flow.

Despite all of the research conducted in this area, no commercially feasible process for the manufacture of ozone bleached lignocellulosic pulps, especially southern softwood, has heretofore been disclosed, and numerous failures have been reported. In addition, applicants are not aware of any commercially feasible non-chlorine bleaching processes which are capable of producing pulps having a GE brightness of at least up to 75, as well as 83 or greater, without a corresponding unacceptable loss in pulp strength.

The present invention provides novel combinations of pulping and bleaching steps which overcome the problems encountered in the prior art as discussed herein and which essentially eliminate the discharge of chlorinated organics and minimizes color and BOD releases to produce a high grade bleached pulp in a commercially feasible manner.

SUMMARY OF THE INVENTION

The present invention provides a multi-stage process for delignifying and bleaching lignocellulosic pulp without the use of elemental chlorine bleaching agents to substantially reduce or eliminate pollution of the environment while optimizing the physical properties of the pulp in an energy efficient, cost effective process. The present invention can work on virtually all wood species, including the difficult-to-bleach southern U.S. softwoods.

Thus, the invention relates to a process for the manufacture of a bleached pulp having a certain GE brightness and a certain strength as indicated by a certain viscosity which comprises:

chemically digesting a lignocellulosic material to initially form a pulp;

oxygen delignifying the pulp to remove a substantial portion of the lignin therefrom, with the combination of the digesting and oxygen delignifying steps being conducted to form an intermediate pulp having a specified amount of lignin and a specified viscosity; and ozone delignifying the intermediate pulp with a gaseous mixture that contains ozone by adjusting the consistency of the pulp to a high consistency of above about 20%, adjusting the pH of the pulp to below about 4, and treating the pulp with an amount of the ozone containing gaseous mixture sufficient to remove a substantial portion, but not all, of the remaining lignin by intimately contacting and turbulently mixing the pulp particles with the gaseous mixture in a dynamic reaction zone for a sufficient time and at a temperature sufficient to allow access of the ozone to substantially all of the pulp for reaction therewith while the pulp advances through substantially all of the reaction zone, thus obtaining substantially uniform delignification of a significant portion of the pulp and forming a delignified pulp having a reduced amount of lignin and the certain strength, viscosity and GE brightness.

In this process, the specified amount of lignin of the intermediate pulp is such that, after ozone delignification, the delignified pulp attains the certain GE brightness, and wherein the specified viscosity of the intermediate pulp is sufficiently high to compensate for viscosity decreases during ozone delignification, thus permitting the delignified pulp to attain the certain strength as evidenced by the certain viscosity.

In addition, the pulp can be washed between the various treatment steps with at least a portion of the wash water effluent from one or more of the pulp washing steps being recycled to another pulp washing step. The bleached pulp washing step comprises washing the pulp with fresh water, and separating the pulp from the resulting wash water effluent. When the bleaching step utilizes chlorine dioxide (preferably having a minimum chlorine content), the bleached pulp wash water effluent is treated by reverse osmosis to form a treated filtrate and at least a portion of the treated filtrate is then used to wash the substantially lignin-free pulp. When the bleaching step utilizes a peroxide compound, at least a portion of the wash water effluent (untreated) can be used to wash the substantially lignin-free pulp.

For countercurrent washing, the substantially lignin-free pulp may be washed with at least a portion of the bleached pulp wash water, with the pulp then being separated from the resulting wash water and at least a portion of the wash water then being used to wash the delignified pulp. The delignified pulp may then be washed with at least a portion of the substantially lignin-free pulp wash water, with the pulp then being separated from the resulting wash water and at least a portion of the wash water being used to wash the intermediate pulp. Next, the intermediate pulp may be washed with at least a portion of the delignified pulp wash water, with the pulp then being separated from the resulting wash water and at least a portion of the wash water being used to wash the initially formed pulp. Finally, the initially formed pulp may be washed with at least a portion of the intermediate pulp wash water, with the pulp then being separated from the resulting wash water so that the wash water can be collected and concentrated prior to incineration in a recovery boiler. In this manner, the water demand for the washing steps is substantially reduced compared to conventional CEDED or OC/DED processes and the discharge effluent has a color of no greater than about 2 pounds per ton, a $BOD_5$ value of no greater than about 2 pounds per ton and an amount of total organic chlorides of no greater than about 2.

The ozone delignification of the pulp is carried out by dispersing the pulp substantially completely throughout the reaction zone while simultaneously conveying the pulp through the reaction zone in a plug flow-like manner at a dispersion index of about 7 or less and preferably below about 4.8, thus exposing substantially all of the pulp to the ozone for reaction therewith. This may be accomplished by introducing the high consistency pulp into the reaction zone at a fill level of at least about 10%;

introducing the ozone containing gaseous mixture into the reaction zone for contact with the pulp; and intimately contacting and mixing the pulp with the ozone by lifting, displacing and tossing the pulp in a radial direction to disperse the pulp and expose substantially all of the pulp to the gaseous bleaching agent while advancing the dispersed pulp axially through the reactor in a plug-flow like manner and at the desired dispersion index for a predetermined time to obtain substantially uniform bleaching of the pulp and to form a bleached pulp having the certain GE brightness, certain strength and certain viscosity.

If desired, the pulp may be fluffed to provide pulp particles having a first bulk density prior to introduction of the pulp particles into the reaction zone; and the pulp particles may be initially conveying at a first conveying rate followed by conveying the pulp at a second lower conveying rate while simultaneously increasing the bulk density of the pulp at the first conveying rate to a second increased bulk density at the second conveying rate. If desired, a substantially constant and predetermined fill level of comminuted pulp particles in the reaction zone can be maintained by initially advancing the relatively low bulk density pulp particles at the first rate and advancing the increased bulk density particles at a second rate which is less than the first rate. The first conveying rate of the pulp can be gradually reduced to the second conveying rate for enhanced operation.

The ozone delignifying step may further comprise removing the gaseous mixture from the reaction zone with entrained pulp particles at a first flow rate; reducing the flow rate of the removed gaseous mixture to a rate where the entrained pulp particles become de-entrained; and returning the de-entrained pulp particles to the reaction zone. Also, the pulp can be separated from the bleaching gas by removing bleached pulp from the reaction zone; spraying the bleached pulp with water to lower the consistency of the pulp and quench the bleaching reaction; and directing the pulp into receiving means by angling the water spray towards the receiving means.

An advantageous ozone delignifying step comprises:

increasing the consistency of the intermediate pulp to at least about 28%;

comminuting the increased consistency pulp into discrete particles of a predetermined particle size having a sufficiently small diameter and a sufficiently low density to facilitate substantially complete penetration of a majority of the pulp particles by ozone gas without causing significant degradation of the cellulose components of the pulp; and uniformly contacting the comminuted pulp particles and the ozone containing gaseous mixture during the turbulent mixing step while the pulp is advanced through the reaction zone for a sufficient time to obtain substantially uniform delignification of a majority of the pulp particles.

The comminuted pulp particles may be advanced through the reaction zone countercurrently to the ozone containing gaseous mixture for contacting the pulp particles which have been bleached to the greatest extent with the ozone containing gaseous mixture containing the maximum concentration of ozone and for contacting the pulp entering the reaction zone with the ozone containing gaseous mixture containing a nearly exhausted ozone concentration, thereby providing optimum consumption of the ozone and uniform delignification of substantially all of the pulp particles. In this regard, the pulp particles may be contacted and mixed with the gaseous bleaching agent by operating conveying means having a plurality of paddle blades arranged upon a rotatable shaft.

The process may be further optimized by controlling at least one of the fill level or residence time of the pulp particles in the reaction zone by selecting a particular paddle design, spacing, pitch, shape or surface area in combination with the rotational speed of the shaft, or by modifying at least one of the paddle design, spacing, pitch, shape or surface area to reduce conveying efficiency and rotating the shaft at higher RPM to compensate for such reduced conveying efficiency, thus obtaining one or more of (1) efficient contact of the pulp particles with the gaseous mixture, (2) increased conversion of the ozone or (3) a substantially constant fill level of pulp particles in the reaction zone.

The oxygen delignification step may be conducted by forming a low to medium consistency pulp; treating the low to medium consistency pulp with an aqueous solution of an alkaline material for a predetermined time and at a predetermined temperature relative to the quantity of the alkaline material to substantially uniformly distribute the alkaline material throughout the low to medium consistency pulp; raising the consistency of the pulp to a high consistency; and subjecting the resulting high consistency pulp to high consistency oxygen delignification to obtain the intermediate pulp. Alternatively, the oxygen delignification treatment may be carried out conventionally on medium consistency pulp.

The oxygen delignification step can be conducted by applying a first amount of alkaline material to brownstock pulp having a consistency of about 10% by weight or less and preferably a low consistency of about 5% or less by combining the pulp with a sufficient quantity of alkaline material with uninterrupted mixing in a manner to ensure that all pulp fibers are exposed to the alkaline material to obtain a substantially uniform distribution of alkaline material throughout the pulp and then increasing the consistency of the alkaline material containing pulp to at least about 18% by weight to obtain high consistency pulp and to remove liquid while retaining the first amount of alkaline material substantially uniformly distributed throughout the high consistency pulp, with the pulp fibers containing the alkaline material being directly passed from the combining step to the consistency increasing step;

optionally applying a second amount of alkaline material onto the high consistency pulp to obtain a total amount of alkaline material on the pulp of at least about 0.8 to 7 percent by weight based on the oven dry weight of the pulp, wherein at least about 55% to 100% of the total amount of alkaline material is applied to the pulp during the alkaline material combining step; and subjecting the increased consistency alkaline material containing pulp to high consistency oxygen delignification to obtain enhanced delignification of the pulp without a corresponding decrease in pulp viscosity compared to pulp which is not combined with alkaline material at low consistencies and form an intermediate pulp having a specified amount of lignin and having a specified viscosity.

The consistency of the pulp which is combined with the aqueous alkaline solution prior to oxygen delignification preferably ranges between about 1 and 4.5% by weight, the consistency of the pulp is increased to between at least about 25% by weight prior to the oxygen delignification step, the high consistency pulp contains an amount of alkaline material of between about 0.8 to 7 percent by weight based on the oven dry weight of the pulp prior to oxygen delignification, and preferably, at least a significant portion of the liquid removed from the consistency increasing step is directly recycled to the alkaline material combining step. Also, the pulp is typically directed to oxygen delignification without any intervening delignification or bleaching steps, and at least about 60% of the liquid removed from the consistency increasing step is directly recycled to the alkaline material combining step.

If desired, prior to the alkaline material combining step, the pulp can be provided with a consistency which is equal to or greater than that of the high consistency pulp which is to be formed so that substantially all removed liquid can be directly recycled to the alkaline material combining step. A predetermined quantity of removed liquid may be accumulated in order to continuously recycle such liquid directly to the alkaline material combining step in the event of intermittent or non-continuous operation of the consistency increasing step. Also, a portion of the liquid removed from the pulp can be recycled for washing the pulp prior to applying the alkaline material.

When the pulp is unbleached softwood pulp, the amount of alkaline material applied to the pulp is between about 1.5 and 4 percent by weight, while for unbleached hardwood pulp, the amount of alkaline material applied to the pulp is between about 1 and 3.8 percent by weight. Thus, after oxygen delignification, the intermediate pulp has a K No. of about 14 or less and a viscosity of greater than about 10 cps, while after ozone delignification, the delignified pulp has a K No. of about 6 or less, a viscosity of greater than about 7 cps and a GE brightness of at least about 35%. Preferable values for softwood include, after the oxygen step, a K No. of about 11 or less and a viscosity of greater than about 12 cps, while after the ozone step, a K No. of about 5 or less, a viscosity of greater than about 9 cps, and a GE brightness of at least about 45%. Preferable values for hardwood include, after the oxygen step, a K No. of preferably about 9 or less and a viscosity of greater than about 12 cps, while after the ozone step, a K No. of about 5 or less, a viscosity of greater than about 9 cps, and a GE brightness of at least about 55%.

In this embodiment, the intermediate pulp can be delignified with an effective amount of ozone for a sufficient time to obtain a delignified pulp having a reduced amount of lignin and the certain GE brightness, strength and viscosity. Typically, the intermediate pulp is directed to ozone delignification without any intervening delignification or bleaching steps.

The lignocellulosic material may be chemically digested by Kraft pulping, Kraft AQ pulping or extended delignification to form the pulp. A chelating agent, such as DTPA, EDTA or oxalic acid, may be added to the intermediate pulp prior to ozone delignification to render metal ions therein substantially non-reactive to ozone and increasing the consistency of the pulp to at least about 20% by weight prior to ozone delignification.

Generally, the delignified pulp is further bleached after ozone delignification with a brightening agent, typically chlorine dioxide or a peroxide, to further increase the GE brightness of the pulp to at least about 70 to 90%.

For this process the delignified pulp may be combined with an effective amount of alkaline material in an alkaline aqueous solution at a predetermined temperature, correlated to the amount of alkaline material combined, to solubilize a substantial portion of any lignin remaining in the bleached pulp; and thereafter extracting a portion of the aqueous alkaline solution so as to remove substantially all of the solubilized lignin therefrom and form an extracted pulp. This step raises the brightness of the pulp by about 2% and is generally conducted after the ozone delignification step but before the brightening step.

The delignified pulp may be bleached by contacting the pulp with from about 0.20 to 0.65% by weight of a peroxide compound for a time of up to about 3 hours to raise the GE brightness thereof to at least about 75. Alternatively, the delignified pulp may be bleached by contacting the pulp for up to about 3 hours with at least about 0.9% by weight of a peroxide compound for a to raise the GE brightness thereof to at least about 83.

Additionally, the delignified pulp may be bleached by contacting the pulp with a sufficient amount of a peroxide compound for between about 2–15 minutes with continuous mixing to raise the GE brightness to at least about 75. Yet another variation has the bleaching step conducted by:

contacting, in an initial bleaching stage, the delignified pulp with a sufficient amount of at least about 0.3% weight of a peroxide compound for a sufficient time of between about 2–15 minutes with substantially constant mixing to raise the intermediate brightness of the delignified pulp by at least about 7 GEB points; and contacting, in a final bleaching stage, the increased brightness pulp with a sufficient additional amount of at least about 0.4% by weight of a peroxide compound for up to about three hours to further raise the GE brightness of the pulp to at least about 83. If desired, the effluent from the final bleaching stage may be recycled to the initial bleaching stage to reduce the total fresh peroxide requirement.

The preferred peroxide compound is hydrogen peroxide, and the pH and consistency of the delignified pulp can be adjusted, prior to bleaching said pulp, to ensure a final pH of between about 9.5–10.5 and a consistency of between about 10–15%, respectively. Also, a sufficient amount of a peroxide stabilizing agent, such as sodium silicate, magnesium sulfate, EDTA, DTPA, oxalic acid or mixtures thereof, to the delignified pulp prior to bleaching the pulp to prevent decomposition of the peroxide compound.

BRIEF DESCRIPTION OF THE DRAWINGS

The above features and advantages of the present invention will become apparent from the following detailed description of the preferred embodiments of the invention as illustrated in the accompanying drawings, wherein.

DETAILED DESCRIPTION OF THE INVENTION

Figure 1:
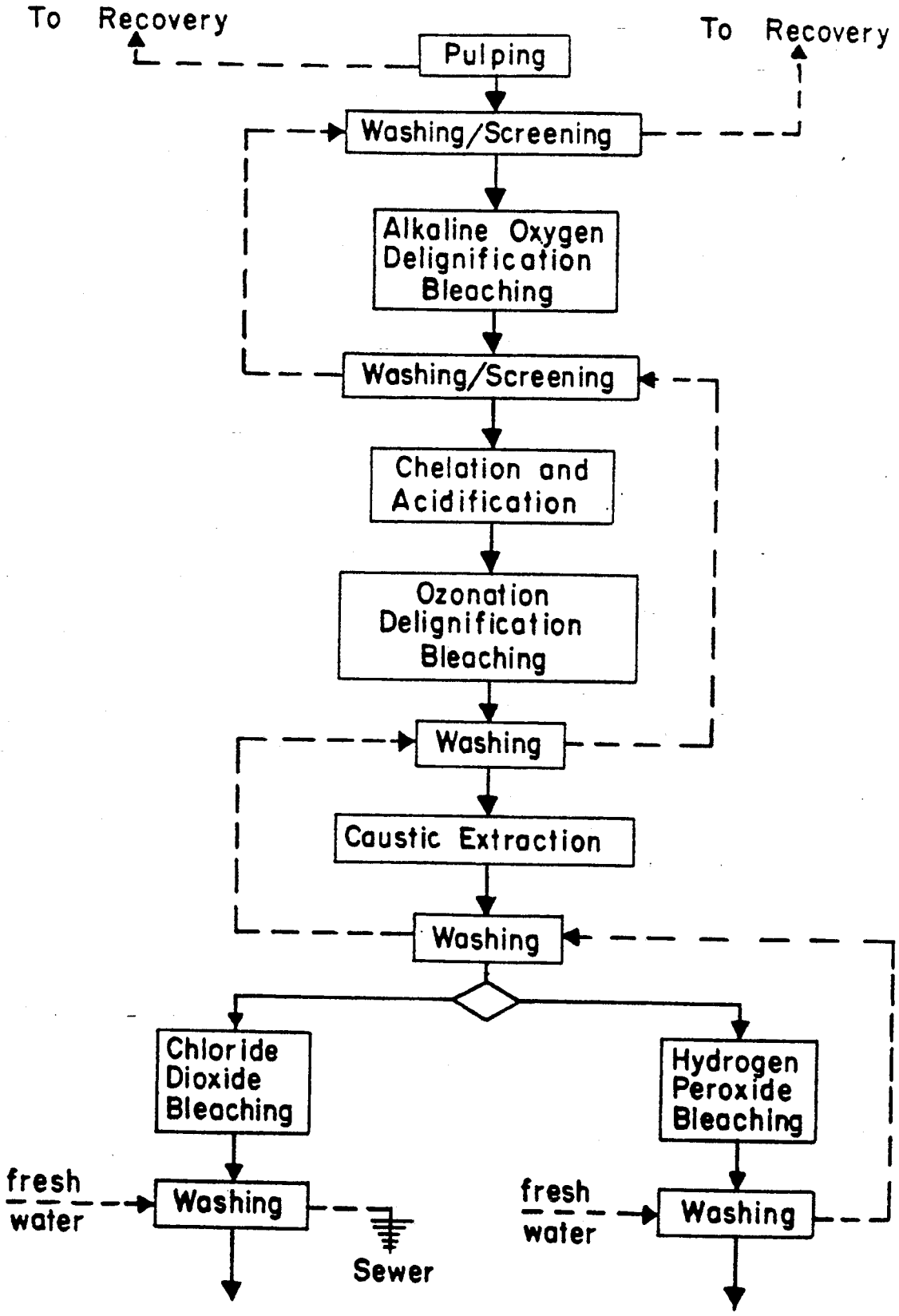
FIG. 1 is a block flow diagram of the preferred methods of this invention wherein a solid line represents pulp flow and a broken line represents effluent flow.

The present invention relates to novel methods for delignifying and bleaching pulp while minimizing the degree of attack upon the cellulosic portion of the wood, thus forming a product having acceptable strength properties for the manufacture of paper and various paper products. For convenience in understanding the improvement over the prior art offered with the use of the presently disclosed delignification and bleaching process, provided below are the definitions of several parameters involved in the various stages in any delignification/bleaching process.

A. General Definitions

Throughout this specification, the following definitions will be used:

"Consistency" is defined as the amount of pulp fiber in a slurry, expressed as a percentage of the total weight of the oven dry fiber and water. It is sometimes also referred to as pulp concentration. The consistency of a pulp will depend upon operation of and the type of dewatering equipment used. The following definitions are based on those found in Rydholm, Pulping Processes, Interscience Publishers, 1965, pages 862–863 and TAPPI Monograph No. 27, The Bleaching of Pulp, Rapson, Ed., The Technical Association of Pulp and Paper Industry, 1963, pages 186–187.

"Low consistency" includes ranges up to 6%, usually between about 3 and 5%. It is a suspension that is pumpable by an ordinary centrifugal pump and is obtainable using deckers and filters without press rolls.

"Medium consistency" is between about 6 and 20%. Fifteen percent is a dividing point within the medium-consistency range. Below 15% the consistency can be obtained by filters. This is the consistency of the pulp mat leaving a vacuum drum filter in the brownstock washing system and the bleaching system. The consistency of a slurry from a washer, either a brownstock washer or a bleaching stage washer, is 9–15%. Above about 15%, press rolls are needed for dewatering. Rydholm states that the usual range for medium consistency is 10–18%, while Rapson states it is 9–15%. The slurry is pumpable by special machinery even though it is still a coherent liquid phase at higher temperatures and under some compression.

"High consistency" is above about 20% up to about 50%. Rydholm states that the usual range is 25–35% and Rapson states that the range is from 20–35%. These consistencies are obtainable only by the use of presses. The liquid phase is completely absorbed by the fibers, and the pulp can be pumped only very short distances.

Further, in this specification "pulping" is used in its conventional sense to refer to a digestion of lignocellulosic material to form brownstock. Pulping would include, for example, Kraft, the Kraft-AQ process and forms of extended delignification.

The term "modified Kraft process" is used herein to include extended delignification and all other modified Kraft processes with the exception of the Kraft-AQ process, since this process has achieved a special status and acceptance in the art and is separately known by that name. Also, the oxygen delignification step following completion of pulping will not be considered as an extended delignification; rather, we have chosen to call it a first step of a delignification process for bleaching or brightening the pulp.

Further, there are two principal types of measurements to determine the completeness of the pulping or bleaching process, i.e., the "degree of delignification" and the "brightness" of the pulp. The degree of delignification is normally used in connection with the pulping process and the early bleaching stages. It tends to be less precise when only small amounts of lignin are present in the pulp, i.e., in the later bleaching stages. The brightness factor is normally used in connection with the bleaching process because it tends to be more precise when the pulp is lightly colored and its reflectivity is high.

There are many methods of measuring the degree of delignification but most are variations of the permanganate test. The normal permanganate test provides a permanganate or "K No." which is the number of cubic centimeters of tenth normal potassium permanganate solution consumed by one gram of oven dried pulp under specified conditions. It is determined by TAPPI Standard Test T-214.

There are also a number of methods of measuring pulp brightness. This parameter is usually a measure of reflectivity and its value is expressed as a percent of some scale. A standard method is GE brightness which is expressed as a percentage of a maximum GE brightness as determined by TAPPI Standard Method TPD-103.

Moreover, where appropriate, the letter codes described in the Background Art section will be utilized to designate the various stages of pulp treatment throughout this Detailed Description of the Invention.

B. The Process Steps of the Invention

The values (i.e., K No., cupriethylenediamine ("CED") viscosity and GE brightness) obtained by use of the present pulping, delignification and bleaching process, as set forth below, demonstrate the ability of this process to enhance the degree of lignin removal from the pulp while minimizing the resultant degradation of the cellulose. After the pulping and oxygen delignification steps, and prior to brightening, the pulp has been delignified to a K No. of about 5 to 14, preferably between about 7 to 11 for U.S. softwoods and about 5 to 8 for U.S. hardwoods. This partially delignified pulp has a viscosity of above about 10, generally more than about 12 and preferably, at least 14 (for softwood pulp) or 15 (for hardwood pulp). This pulp thus has good strength and suitable viscosity so that it can withstand the effects of ozone.

The pulp is then further delignified by being subjected to ozone, thus reducing the K No. of the pulp to less than 6 and preferably about 3 to 5 for both softwoods and hardwoods, while the viscosity is maintained at greater than about 7 cps and preferably greater than about 9 cps. After ozone delignification, the GE brightness of the pulp is increased to at least about 35–65%. For softwood pulp, a GE brightness of about 45–55% or higher is typically achieved, while for hardwood pulp, values of about 55–65% or more are attained. Thereafter, the brightness of the pulp is further increased by an alkali extraction and an additional bleaching step using chlorine dioxide or peroxide.

For convenience in understanding the present invention therefore, FIG. 1 sets forth, in schematic form, the various stages utilized in pulping, delignifying and brightening a pulp according to the invention. As illustrated in FIG. 1, the invention comprises a multi-stage process including the steps of:

a) pulping the lignocellulosic material whereby the pulping chemicals may be recovered and reused in a manner well-known in the art;
b) washing the pulp to remove chemical residues from the pulping liquor together with residual lignin and usually including a screening of the pulp to remove fiber bundles that have not been separated during pulping;
c) alkaline oxygen delignification (i.e., O or $O_m$) of the pulp;
d) washing the partially delignified pulp obtained in step c) above to remove dissolved organics from the oxygen treatment; optionally, screening may be done at this point, while also recycling at least a portion of the effluent from this step to a previous step;
e) chelation and acidification of the pulp to bind metal ions and to adjust the pH to a preferred level;
f) contacting the pulp with ozone (i.e., Z or $Z_m$) to further delignify and to partially bleach this material;
g) washing the ozonated pulp, while recycling at least a portion of the effluent from this step to a previous step;
h) caustic extraction to remove residual lignin;
i) washing the extracted pulp while recycling at least a portion of the effluent to a previous step;
j) adding a second bleaching agent (i.e., D or P to brighten and bleach the pulp);
k) washing the bleached pulp to obtain a bleached product having a GE brightness of about 70 to 90%; and
l) recycling at least a portion of the effluent from the P bleaching stage to a previous step; or sewering the effluent from the D bleaching stage or, after appropriate treatment, recycling this effluent to a previous step.

The process of the present invention is composed of three or more steps with a number of possible variations within and between the steps.

1. Pulping

A first step involves delignification of wood chips into a lignocellulosic pulp, using any one of several chemical pulping processes, followed by a washing removal of most of the dissolved organics and cooking chemicals for recycle and recovery. Usually included is a screening of the pulp to remove bundles of fibers that have not been separated in pulping. This delignification step is conducted so that, for a southern U.S. softwood, for example, pulp with a K No. in the range of about 20–24 (target of 21), a CED viscosity in the range of about 21–28, and a GE brightness in the range of about 15–25 is typically obtained. For southern U.S. hardwood, pulp with a K No. in the range of about 10–14 (target 12.5) and a CED viscosity of about 21–28 is typically obtained.

The particular pulping process used in the method of the invention is, to a large extent, dependent on the type of lignocellulosic materials and, more particularly, the type of wood which is used as a starting material. Among, but not limited to, the effective embodiments of this first step are:

a) Kraft pulping using either a continuous or batch digestion stage;
b) Continuous digestion kraft pulping with extended delignification using staged alkali addition and countercurrent final cooking;
c) Batch digestion kraft pulping with extended delignification using rapid liquor displacement and cold blowing techniques; or
d) Kraft-AQ pulping to achieve extended delignification using either a continuous or batch digestion stage. Depending upon the type of lignocellulosic material, conventional soda and sulfite processes may be used.

The first stage in the method of the present invention wherein procedures can be utilized which improve the amount of lignin removed from the lignocellulosic material while minimizing the amount of degradation of the cellulose, is in the pulping step. Moreover, the pulping liquor used in chemical pulping techniques may be recovered and reused in a manner wellknown in the art. This step is typically followed by washing to remove most of the dissolved organics and cooking chemicals for recycle and recovery, as well as a screening stage in which the pulp is passed through a screening apparatus to remove bundles of fibers that have not been separated in pulping.

The Kraft process is generally acceptable for use with all woods as compared to the other noted processes, as the final pulps obtained from the Kraft process have acceptable physical properties, although the brownstock pulp is also darker in color.

Depending upon the lignocellulosic starting material, the results obtained with conventional Kraft processes may be enhanced by the use of extended delignification techniques or the Kraft-AQ process. Moreover, these techniques are preferred for obtaining the greatest degree of reduction in K No. of the pulp without deleteriously affecting the strength and viscosity properties of the pulp.

When using the Kraft-AQ technique, the amount of anthraquinone in the cooking liquor should be an amount of at least about 0.01% by weight, based on the oven dried weight of the wood to be pulped, with amounts of from about 0.02 to about 0.1% generally being preferred. The inclusion of anthraquinone in the Kraft pulping process contributes significantly to the removal of the lignin without adversely affecting the desired strength characteristics of the remaining cellulose. Also, the additional cost for the anthraquinone is partially offset by the savings in cost of chemicals in the subsequent $Z_m$, E and D or P steps.

Alternatively, or perhaps even additively to Kraft-AQ, is the use of techniques for extended delignification such as the Kamyr MCC, Beloit RDH and Sunds Cold Blow Methods for batch digesters. These techniques also offer the ability to remove more of the lignin during pulping without adversely affecting the desired strength characteristics of the remaining cellulose.

2. Oxygen Delignification

A second step of the process includes an oxygen delignification treatment to further remove lignin without an accompanying significant loss in cellulosic fiber strength. This would include a washing removal of the dissolved organics and alkali for recycle and recovery. Pulp screening is also performed at times after oxygen delignification.

The oxygen delignification step may be conducted by:

a) conventional oxygen delignification, comprised of an alkaline oxygen treatment of the pulp at either low, medium, or high pulp consistency (O); or b) an alkaline treatment at low to medium pulp consistency, followed by high pulp consistency oxygen treatment ($O_m$).

The treatment step of the $O_m$ process comprises substantially uniformly combining wood pulp, preferably brownstock pulp, with an aqueous alkaline solution while maintaining the consistency of the pulp at less than about 10% and preferably about 5% by weight or less. This step uniformly distributes the aqueous alkaline solution throughout the low consistency pulp and ensures that substantially all the pulp fibers are exposed to a uniform application of alkaline solution.

Surprisingly, the pulp treated in this manner is not substantially delignified in the combining step, but it is more effectively delignified in the subsequent high consistency oxygen delignification step than pulp that is treated with alkaline solutions at high consistency according to the methods conventionally employed. The localized inhomogeneities in the distribution of alkali in conventional high consistency pulp are avoided, thus eliminating attendant non-uniform oxygen delignification.

This homogeneous distribution step thus preferably comprises uniformly combining the pulp with an aqueous alkaline solution for at least about 1 minute and preferably no more than about 15 minutes. It is believed that treatment times of less than about 1 minute will not generally provide sufficient time to attain substantially uniform distribution, whereas treatment times in excess of about 15 minutes are not expected to produce substantial further benefit.

Moreover, the preferred alkaline treatment of pulp according to the present invention may be carried out over a wide range of temperature conditions. According to a preferred practice, the treatment step is carried out at a temperature of from about room temperature to about 150° F., with temperatures ranging from about 90° to 150° F. being even more preferred. Atmospheric pressure or elevated pressure may be employed. The treatment step is completed when the aqueous alkaline solution is substantially uniformly distributed throughout the low consistency pulp. The amount of aqueous alkaline solution present in the treatment step can vary greatly according to the particular process parameters of the delignification reaction. The amount of the alkaline solution effective for the purpose of the present invention will depend primarily upon the extent of delignification desired in the oxygen bleaching step and the strength of the particular solution being used.

Further details and examples of the $O_m$ process are found in U.S. patent application Ser. No. 07/686,062, now U.S. Pat. No. 5,217,574, the content of which is expressly incorporated herein by reference thereto.

Following the low consistency alkaline treatment step described above, the consistency of the treated pulp is increased to greater than about 18–20%, preferably from about 25% to about 35%. Several methods are available and well known in the art for increasing the consistency of the pulp, such as pressing the wood pulp to remove liquid (also called pressate) therefrom. Thus, after thickening, the pulp contains an amount of about 0.8% to about 7%, and preferably about 1–3% by weight active alkali based upon the oven dry pulp weight of the pulp. A significant amount (i.e., at least about 25%) of the pressate is recycled for use in the low consistency pulp combining step. Preferably, at least about 40% is recycled, more preferably about 60–80%, to conserve alkaline material.

Thereafter, oxygen delignification is conducted on the high consistency pulp. Methods are available and well known in the art for dissolving gaseous oxygen into the liquid phase of high consistency pulp to affect delignification thereof. It is contemplated that any of these well known methods are adaptable for use according to the present invention. It is preferred, however, that oxygen delignification according to the present invention comprise introducing gaseous oxygen at about 80 to about 100 psig into the liquid phase of the high consistency pulp while maintaining the temperature of the pulp between about 90° and 130° C. The average contact time between the high consistency pulp and the gaseous oxygen is preferably from about 20 to 60 minutes.

By following this process, it is possible to obtain a reduction in K No. for the pulp after the oxygen delignification step of at least about 60% with essentially no damage to the cellulose portion of the pulp. By comparison, conventional oxygen delignification can only achieve reductions in K No. of about 50% before degradation of cellulose occurs. Thus, the present preferred process unexpectedly provides an increase of at least 20% in delignification compared to prior art delignification processes: i.e., from 50% to at least about 60% reduction of the K No. for the incoming pulp. Reductions of 70% and more can even be achieved with minimal cellulose degradation. The avoidance of deterioration of the cellulose component of the pulp is evident by the minimal change in viscosity of pulp which is treated in accordance with the present invention.

Advantageously, this oxygen delignification treatment is carried out using a two-stage "$O_s$" (s=split) alkali addition process. In the first stage, a first amount of alkaline material is applied to pulp at low consistency by combining the pulp with a quantity of alkaline material in an aqueous alkaline solution. The consistency of the pulp is then increased to a high consistency of at least about 18%. Next, a second amount of alkaline material is applied onto the high consistency pulp to obtain a total amount of alkaline material applied to the pulp. When at least about 55% of the total amount of alkaline material on the pulp is applied during the low consistency combining step, the enhanced delignification selectivities of the $O_m$ process can be achieved. After this stage, the pulp is then subjected to oxygen delignification to achieve such enhanced delignification selectivities.

Further details and examples of the $O_s$ process are found in U.S. patent application Ser. No. 07/637,100, now abandoned, the content of which is expressly incorporated herein by reference thereto.

Upon entering the oxygen delignification step, pulp K Nos. range from about 10–26 depending upon the type of wood (e.g., for Kraft pulping, about 10–14, target 12.5 for hardwood and about 20–24, target 21, for softwood), while after oxygen delignification, the K No. is generally in the range of about 5–14. After oxygen delignification, the thus formed intermediate pulp generally would have a K No. of about 14 or less, and a viscosity of above about 10.

For pulp end uses that do not require high brightnesses (often referred to as semi-bleached pulp), it is possible to use pulp that has been processed only through step 2 directly in the papermaking process.

Figure 2:
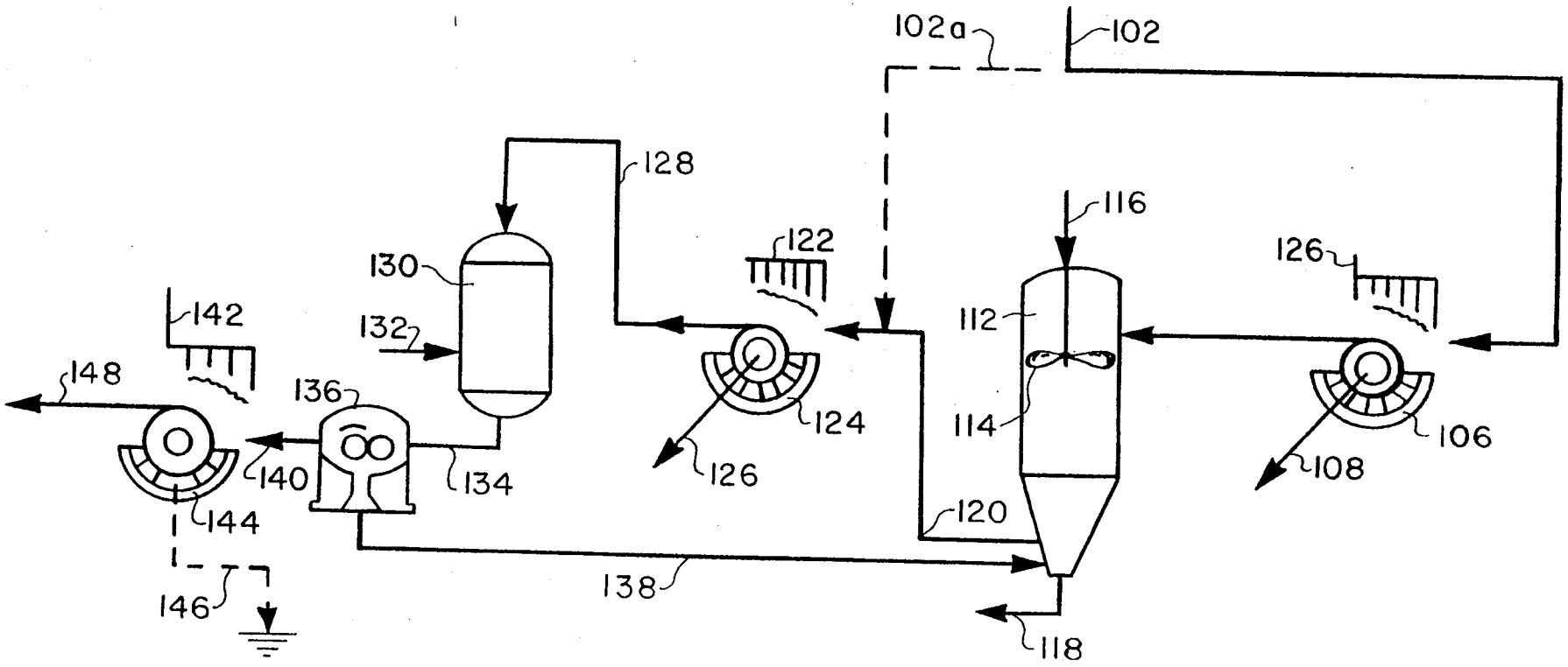
FIG. 2 schematically illustrates the pulping, oxygen delignification and ozone delignification steps of the process of the invention.

A processing scheme for carrying out the steps of pulping, oxygen delignification and ozone delignification is depicted in schematic form in FIG. 2. The steps depicted therein represent a preferred operating system that maximizes the benefits of the present invention.

Wood chips 2 are introduced into a digester 4 where they are cooked in a liquor such as a liquor of sodium hydroxide and sodium sulfide. The cooking unit 4 produces a Kraft brownstock 8 and a black liquor 6 containing the reaction products of lignin solubilization. The brownstock is treated in washing units comprising, preferably, blow tank 10 and washer 12 where residual liquor 14 contained in the pulp is removed.

Many methods are available and well known in the art for washing brownstock, such as diffusion washing, rotary pressure washing, horizontal belt filtering, and dilution/extraction. These methods are all within the scope of the present invention.

A wash press can be used instead of washer 12 to enable pulp of higher consistency to enter the alkaline material treatment section. Also, screening of brownstock is often done either before or after the washing or wash pressing steps in order to remove larger portions of undefibered wood for special processing.

Washed brownstock 16 is introduced into a mixing chest 18 where it is substantially uniformly treated with sufficient alkaline material 20 for a time sufficient to distribute a first amount of alkaline material throughout the pulp. The low consistency treatment portion of this $O_s$ process is carried out in the same manner as the $O_m$ process, but less alkaline material (i.e., about half as much) is applied to the pulp. In the $O_m$ process, an aqueous sodium hydroxide solution is combined with the low consistency pulp in an amount sufficient to provide essentially the same amounts on the OD pulp as was achieved by the O process. In the $O_s$ process, at least about 0.4% to about 3.5% by weight of sodium hydroxide is distributed throughout the low consistency pulp after thickening, with the balance applied to the high consistency pulp. Other alkali sources having equivalent sodium hydroxide content can also be employed instead of sodium hydroxide if desired. Oxidized white liquor is a convenient plant stream which may be utilized for this purpose.

The alkaline treated pulp 22 is forwarded to a thickening unit 24 such as a twin roll press where the consistency of the pulp is increased to the desired level. The pulp consistency increasing step also removes residual liquid or pressate 26. A portion 28 of this pressate 26, may be directly recycled back to brownstock washer 12. Alternately, a portion 30 may instead be directed to mixing chest 18 for use in the low consistency pulp alkaline treatment step. Since the consistency of the pulp is increased in the thickening unit 24, a certain amount 32 of pressate may continually be discharged to the plant liquid recovery system to maintain water balance in the mixing chest 18.

The present process recycles a substantial portion of at least about 25% of the pressate (the untreated liquid removed during the consistency increasing step) directly to the alkaline material combining step. Preferably, above 40% up to substantially all of the pressate may be recycled. Recycling pressate is beneficial and essential to the economics of this process due to the relatively high concentrations of alkaline materials which are used. It is noted that the amount of removed liquid to be recycled is ordinarily not 100%, since water balance could not otherwise be maintained in the system. Liquid from the source of alkaline material 20 added to vessel 18, removed liquid 26, and liquid entrained in pulp 16 coming from washing unit 12 would continue to build up in the system because the amount of alkaline material removed from the system on the pressed brownstock 34 is relatively low. Accordingly, FIG. 2 properly illustrates that a portion 30 of the removed liquid may be directed to washing unit 12 where excess liquid 14 can be drained or removed to maintain water balance. In actual practice, between about 75–95% of the removed liquid 30 is directly recycled to vessel 18, with the balance being directed to the washer 12 via 55 or otherwise removed from the system via 32.

While the $O_m$ process is preferred over the standard "O" method, the alternate $O_s$ technique is most preferred because a lower proportion of the alkaline material (i.e., than is used with the Om process) is applied to the low consistency pulp. This, in turn, reduces the amount of alkaline material utilized in mixing chest 18 and also reduces the amount of this material removed via pressate discharge 32 (see below). Thus, splitting the application of the alkaline material between the high and low consistency pulp reduces the amount of pressate discharge 32 which, in turn, reduces the amount of alkaline material which must be reintroduced, thus saving chemical. Further the high consistency alkaline treatment portion of the $O_s$ method permits rapid modification of the amount of the alkaline material present in the pulp entering the oxygen delignification reactor to compensate for changes in the properties (i.e., wood type, Kappa or K. No. and viscosity) of the incoming brownstock, or to vary the degree or extent of oxygen delignification for a particular pulp.

Therefore, additional alkaline material 36 is applied to the high consistency brownstock 34 produced by the thickening unit 24 to obtain the desired total amount of alkaline material on the pulp prior to oxygen delignification. This total amount of alkaline material is selected to achieve the desired extent of delignification in the subsequent oxygen delignification step which is carried out on the alkaline material treated high consistency pulp. The total amount of alkaline material actually applied onto the pulp will generally be between 0.8 and 7% by weight based on oven dry ("OD") pulp, and preferably between about 1.5 and 4% for southern softwood and between about 1 and 3.8% for hardwood. About half these amounts are preferably applied in each of the low consistency and high consistency treatments. Thus, about 0.4 to 3.5% by weight, preferably about 0.5 to 1.9% for hardwood and 0.75 to 2% for softwood, is applied onto the pulp during each of the low and high consistency alkaline treatments.

The alkaline treated pulp 38 is then forwarded to the oxygen delignification reactor 40 where it is contacted with gaseous oxygen 42. Suitable conditions for oxygen delignification according to either the O, $O_m$ or $O_s$ processes comprise introducing gaseous oxygen at about 80 to about 100 psig to the high consistency pulp while maintaining the temperature of the pulp between about 90° and 130° C. The average contact time between the high consistency pulp and the gaseous oxygen ranges from about 15 to 60 minutes.

After oxygen delignification in reactor 40, the partially delignified pulp 44 is forwarded to washing unit 46 wherein the pulp is washed with water 48 to remove any dissolved organics and to produce high quality, low color pulp 50. A first portion 54 of the oxygen stage washer 46 filtrate 52 can be used to advantage in a first shower on the brownstock washer 12. This improves washing and reduces the pressate portion 55 which is used in a second shower on washing unit 12 and later returns into the residual liquor 14 which is sent to the plant recovery without further reuse. A second portion 56 of filtrate 52 is discharged directly to the plant recovery system.

When a wash press is used at 12, it is possible to recycle substantially all of the pressate to the alkaline material mixing chest 18 to conserve alkaline material. Thus, the only additional alkaline material that must be added to mixing chest 18 is that which is retained within the pulp and is removed at 34.

The effluent 14 from washing unit 12 may be recycled alone or optionally with all or a portion of effluent 38, to either the blow tank 10 or ultimately the black liquor line 6. Additionally, the partially delignified pulp obtained after oxygen delignification may be screened to remove fiber bundles from the pulp that have not separated for further treatment such as mechanical grinding. From here, pulp 36 is generally sent to subsequent bleaching stages.

3. The Ozone Step

A third step of the process includes an acidic, gaseous ozone bleaching treatment (Z or $Z_m$) under defined process parameters to provide a highly selective removal and bleaching of lignin with minimal degradation of cellulose. Among the process parameters are chelating agents for metal ion control, pH control, pulp particle size control, pulp consistency, ozone concentration and gas/pulp contact control.

Treating pulp at high consistencies with ozone without paying particular attention to the comminution of the pulp fibers or to the proper contact between the individual fibers and the reactant gas stream invariably results in a non-uniform ozone bleaching of the fibers. The present application designates such a non-uniform ozone treatment with the letter "Z". The use of a modified ozone technique according to the present invention, as discussed above, in which the fibers are comminuted to a size of about 6 mm or less and are properly and uniformly contacted with the ozone gas stream, has been designated herein as "$Z_m$".

It has been found that pulps with K Nos. greater than about 14 after the second step are not suitable for this third step, because of the substantial amounts of ozone required to reduce the K No. to the desired level, which typically results in the properties of the pulp being adversely and deleteriously affected by excessive ozone degradation of the cellulose fibers of the pulp. When pulp having a K No. of less than 14 is ozonated, a lesser concentration of ozone is used, with only a minimal amount of cellulose degradation occurring. The product from this ozonation step for either the starting southern U.S. softwood or hardwood described above is a pulp having a K No. of about 6 or less and generally in the range of about 3 to 5 (target of 3.5), a viscosity of above about 7, and a GE brightness of at least 35% (typically about 45% or higher for softwood and 55% or higher for hardwood).

Prior to treatment with ozone, the pulp is conditioned so as to ensure the most effective selective delignification and to minimize the chemical attack of the ozone on the cellulose. As illustrated in FIG. 2, the incoming pulp 50 is directed into a mixing chest 58, where it is diluted to a low consistency. An organic or inorganic acid 60 such as sulfuric acid, formic acid, acetic acid or the like, is added to the low consistency pulp to decrease the pH of the pulp in mixing chest 58 to the range of about 1 to 4 and preferably between 2 and 3.

The acidified pulp is treated with chelating agent 62 to complex any metals or metal salts which may be present therein. This chelating step is used to render such metals non-reactive or harmless in the ozone reactor so that they will not cause breakdown of the ozone, thus decreasing the efficiency of the lignin removal and also reducing the viscosity of the cellulose. Preferred chelating agents for this ozone treatment, for reasons of cost and efficiency, include diethylenetriamine pentacetic acid ("DTPA"), ethylenediamine tetraacetic acid ("EDTA") and oxalic acid. Amounts of these chelating agents ranging from about 0.1% to about 0.2% by weight of oven dry pulp are generally effective, although additional amounts may be needed when high metal ion concentrations are present.

The acidified, chelated, low-consistency pulp 64 is introduced into a thickening unit 66, such as a twin roll press, for removing excess liquid 68 from the pulp, wherein the consistency of the pulp is raised to a level above about 20%. At least a portion of this excess liquid 68 may be recycled to mixing chest 58 with a remaining portion **68*a* being directed to the plant recovery. The resultant high consistency pulp 70 is then passed through compaction device 72 such as a screw feeder which acts as a gas seal for the ozone gas and thereafter through a comminuting unit 74**, such as a fluffer, for use in reducing the pulp particle size as described below.

A preferred range of consistency, especially for southern U.S. softwood, has been found to be between about 28% and 50%, with the optimum results being obtained at between about 38% and 45% prior to contact with ozone. Within the above ranges, preferred results are obtained as indicated by the relative amount of delignification, the relatively low amount of degradation of the cellulose, and the noticeable increase in the brightness of the treated pulps.

The reaction temperature at which the ozone bleaching is conducted is likewise an important factor in the process of the present invention. The maximum temperature of the pulp at which the reaction should be conducted should not exceed the temperature at which excessive degradation of the cellulose occurs, which with southern U.S. softwood is a maximum of about 120° F.-150° F.

The time of the reaction used for the ozone bleaching step is determined by the desired rate of completion of the ozone bleaching reaction as indicated by complete or substantially complete consumption of the ozone which is utilized. This time will vary depending upon the concentration of the ozone in the ozone gas mixture, with relatively more concentrated ozone mixtures reacting more quickly, and the relative amount of lignin which it is desired to remove. The time required is preferably less than two minutes, but the procedure may take substantially longer depending on other reaction parameters.

An important feature of the ozone stage of the invention is that the pulp be uniformly bleached by the ozone. This uniform bleaching is obtained, in part, by comminution of the pulp into discrete floc particles of a size which is of a sufficiently small diameter and of a sufficiently low bulk density so that the ozone gas mixture will completely penetrate a majority of the fiber flocs. Generally, a comminuted pulp particle size of 6 mm or less has been found to be acceptable.

During the ozone bleaching process, the particles to be bleached should be exposed to the gaseous ozone bleaching agent by mixing so as to allow access of the ozone gas mixture to all surfaces of the flocs and equal access by the ozone gas mixture to all flocs. The mixing of the pulp in the ozone gas mixture gives superior results with regard to uniformity as compared to the results obtained with a static bed of flocs which results in channeling wherein some of the flocs are isolated from the ozone gas relative to other flocs and are thereby bleached less than other flocs.

Upon exiting fluffer 74, the oxygen delignified pulp particles 76 enter a reactor apparatus 78 adapted for bleaching these particles from a first GE brightness to a second, higher GE brightness. The pulp fiber particles 76 are bleached by the ozone in reactor 78 typically to remove a substantial portion, but not all, of the lignin therefrom. A preferred apparatus for conducting ozone delignification is the paddle reactor described in U.S. patent application Ser. No. 07/821,117 the content of which is expressly incorporated herein by reference.

As the pulp particles are advanced through this reactor, an internal conveyor 80, preferably in the form of a rotating shaft 82_to which is attached a plurality of paddle members 84, powered by motor 86, in a helical 240 quarter pitch pattern is used to provide intimate contact and turbulent mixing between the pulp particles and the ozone gas. These conveying means displace, lift and toss the pulp particles in a radial and forward direction while also inducing the ozone to flow and surround the displaced and tossed pulp particles, to expose substantially all surfaces of a majority of these particles to the ozone. This facilitates substantially complete penetration of all surfaces of these particles by the ozone.

At low RPMs, the paddles move the pulp in a manner such that it appears to be "rolling" or "lifted and dropped" through the reactor. At higher RPMs, the pulp is dispersed into the gas phase in the reactor, with the pulp particles uniformly separated and distributed throughout the gas, causing uniform bleaching of the pulp. The overall bleaching rate of the pulp particles is thus significantly improved compared to prior art bleaching methods utilizing fast-reacting gaseous bleaching agents such as ozone.

The forward movement of the dispersed pulp approximates plug flow and facilitates a high degree of bleaching uniformity. The reactor is operated at a dispersion index of less than 7, preferably less than about 4.8, at all rotational speeds of less than about 125 rpm and is designed to simultaneously control pulp contacting, pulp residence time and gas residence time while effectively consuming up to 99 percent of the ozone. In this way the pulp is bleached to the desired degree while a significantly high conversion of ozone gas bleaching agent is achieved.

The ozone gas which is used in the bleaching process may be employed as a mixture of ozone with oxygen and/or an inert gas, or it can be employed as a mixture of ozone with air. The amount of ozone which can satisfactorily be incorporated into the treatment gases is limited by the stability of the ozone in the gas mixture. Ozone gas mixtures which typically contain about 1-8% by weight of ozone in an ozone/oxygen mixture, or about 1-4% ozone in an ozone/air mixture, are suitable for use in this invention. The ozone gas can be introduced at any position through the outer wall of the shell of the reactor.

As shown in FIG. 2, ozone gas 88 is introduced into the reactor 78 in a manner such that it flows, in one embodiment of the invention, countercurrent to the flow of the pulp. If desired, cocurrent ozone gas flow can be used instead of countercurrent flow.

Any residual ozone gas 90, as it exits reactor 78, is directed to a carrier gas pretreatment stage 92 where a carrier gas 94 of oxygen or air is added. This mixture 96 is directed to ozone generator 98 where the appropriate amount of ozone is generated to obtain the desired concentration. The proper ozone/air or ozone/oxygen mixture 100 is then directed to reactor vessel 78 for delignification and bleaching of pulp particles 76.

Pulp fiber flocs 102, after treatment, are directed into tank 104 by spray from water nozzles which create a water shower that soaks the pulp and quenches the ozone bleaching reaction on the pulp particles. It is desirable that the quenching occur as uniformly and as quickly as possible in order to preserve the bleaching uniformity achieved in the reactor apparatus. Thus, these nozzles are arranged to provide an even, soaking shower of water while also being angled downward at an angle of at least 30° with respect to the horizontal and preferably at about 45°, in order to force the pulp down into the tank and avoid the formation of a water curtain which would inhibit the free fall of the pulp. The pulp is collected in this tank 104 and transported to the a subsequent bleaching treatment stage described below.

Pulp exiting the ozone reactor has a GE brightness of about at least 35 percent and generally around 45 to 63 percent, with hardwoods usually being above about 50 percent. The pulp (for hardwoods or softwoods) also has a K No. of between about 3 and 6.

Figure 3:
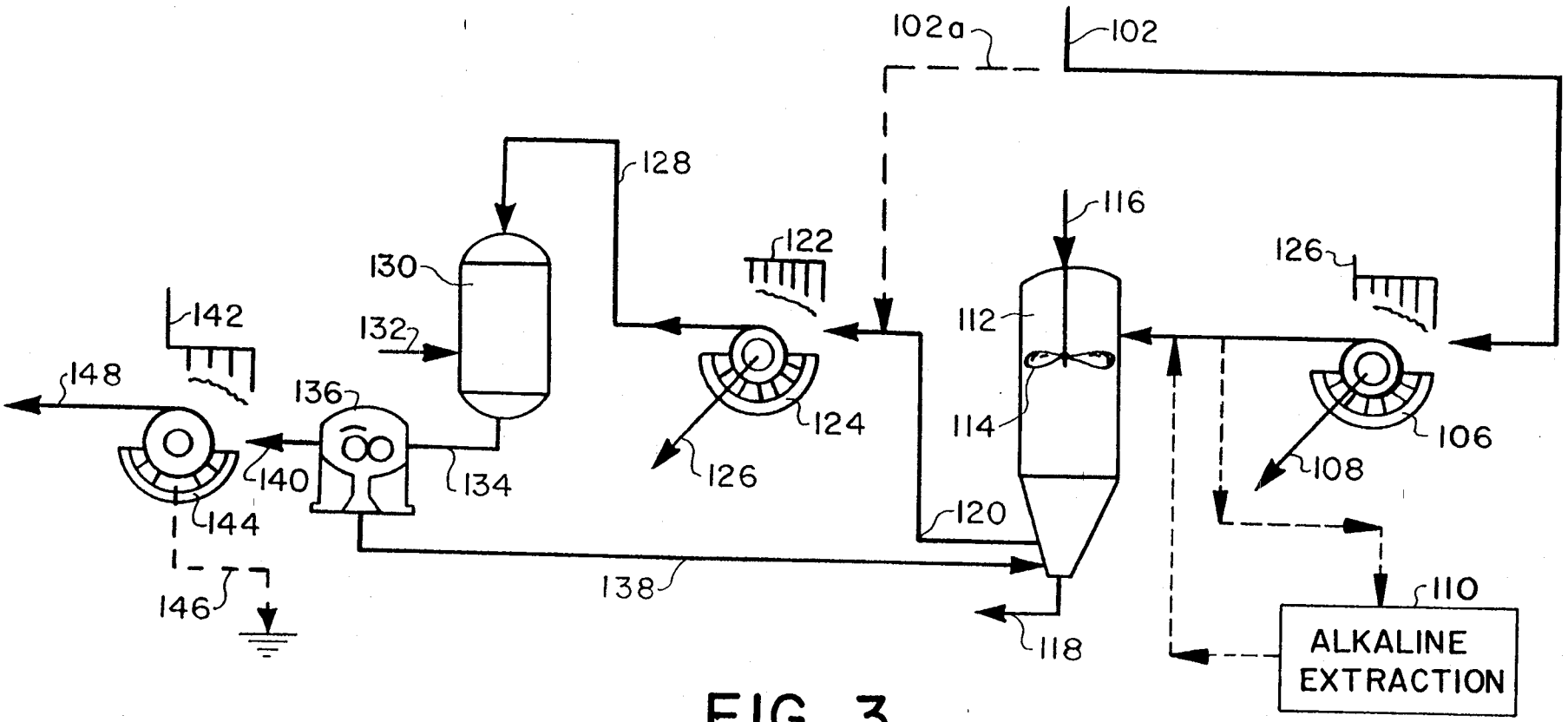
FIG. 3 schematically illustrates a peroxide bleaching stage of a preferred process of the invention.
Figure 4A:
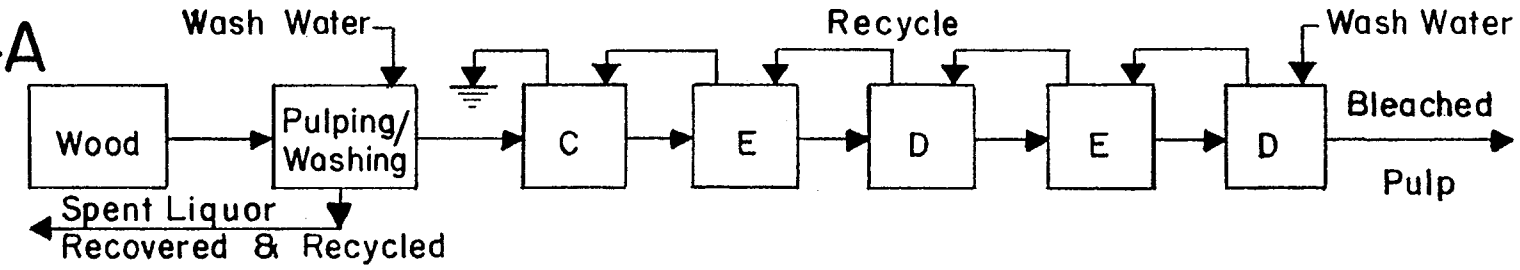
FIGS. 4A, 4B, 4C and 4D are a comparison of the recycle and waste streams for a variety of pulp treatment processes.
Figure 4B:
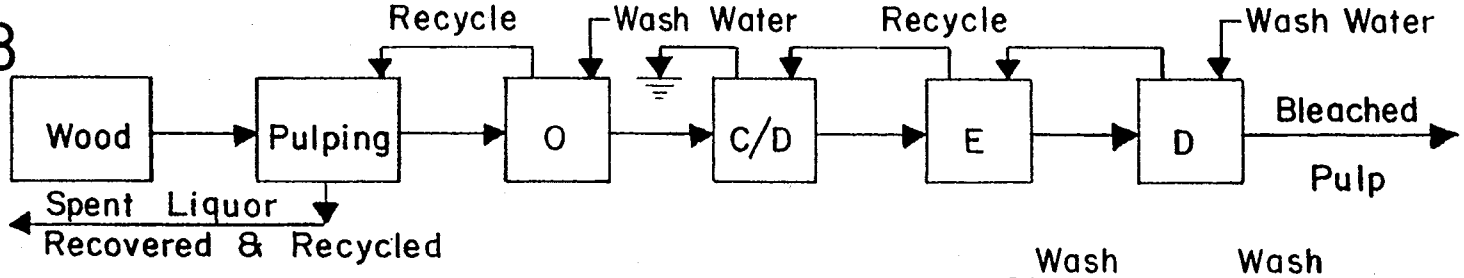
Figure 4C:
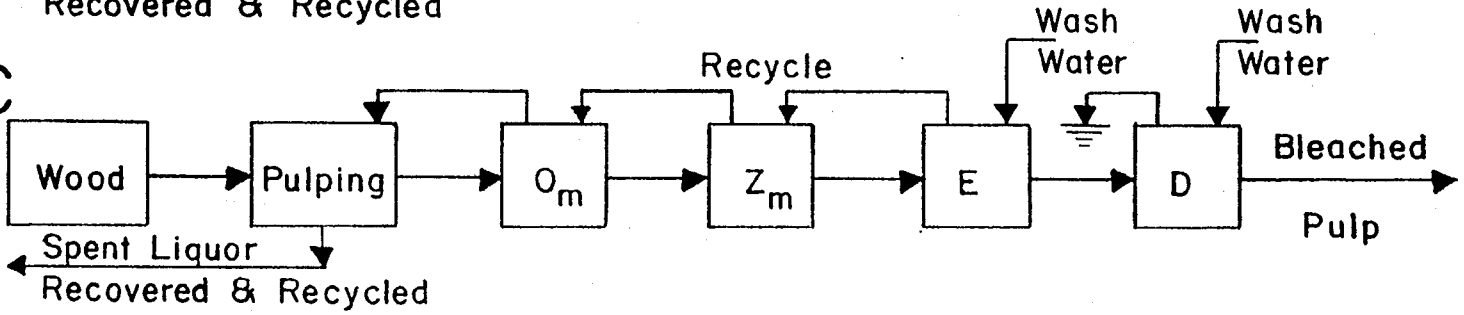
Figure 4D:
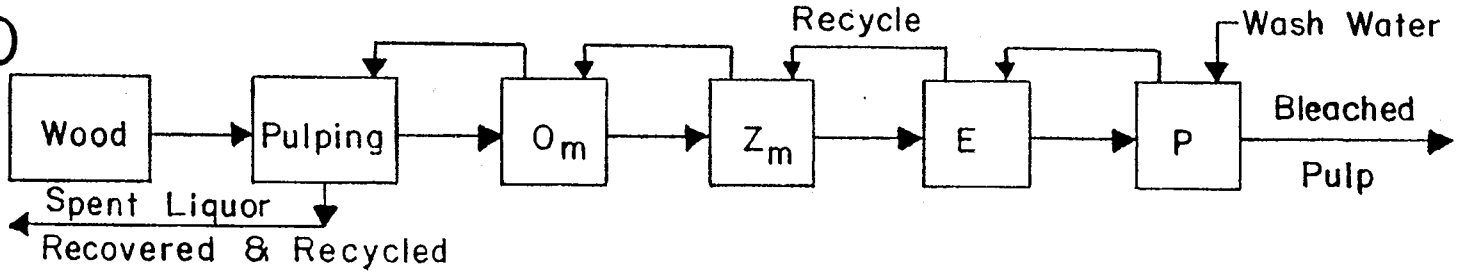

After completion of the ozone bleaching step, the substantially delignified pulp 102 is again thoroughly washed in washer 106 as shown in FIG. 3 and at least a portion of the water 108 which is recovered is recycled to washing unit 46 of the process, thereby producing major environmental benefits from the elimination of sewered liquid.

4. Alkaline Extraction

An additional bleaching step may then be used to bring the pulp to a desired fully bleached state, i.e., one having GE brightness levels of about 70 to 90% using any one of a number of bleaching and extraction processes. Among, but not limited to, the effective embodiments are:

a) A conventional extraction stage with washing followed by a peroxide stage with washing (i.e., EP);
b) Conventional alkali extraction and washing stages followed by a conventional chlorine dioxide stage with washing (i.e., ED);
c) A conventional alkali extraction and washing stage followed by a conventional chlorine dioxide stage with washing, followed by a repeat of the extraction and chlorine dioxide stages (i.e., EDED); or
d) An extraction stage, augmented with either oxygen, peroxide or both, followed by a conventional chlorine dioxide stage (i.e., $E_oD$, $E_pD$ or $E_{op}D$).

The extraction stage is optional as the pulp can be directly forwarded from the ozone reactor to one or more subsequent brightening stages. Thus, additional embodiments include:

e) A peroxide stage (P) optionally conducted on medium consistency pulp with high shear mixing; or
f) Two peroxide stages (P,P) separated by a washing stage.

The $E_oD$, $E_{pD}$, $E_{op}D$ or EDED embodiments are preferred for achieving the highest brightness levels. For the ED embodiment, the chlorine dioxide stage filtrate cannot, without treatment, be recycled for chemical recovery because of the presence of the inorganic chlorides. Since this is the only required sewered filtrate from the process, however, dramatic reductions in effluent volume, color, COD, BOD, and chlorinated organics are achieved. Color of less than 2 pounds per ton, $BOD_5$ of less than 2 pounds per ton and total organic chloride (TOCl) of less than 2 and preferably less than 0.8 can be achieved. It is also possible to treat the chlorine dioxide stage filtrate with a membrane filtration process which will allow essentially complete recycle. In the EP, P or P,P embodiments, no chlorinated materials are formed in the bleaching process and virtually all the liquid filtrates can be recycled and recovered, producing an almost effluent-free process.

The washed pulp 102 from the ozone stage may be forwarded to an alkaline extraction stage 110, where it is combined with a sufficient amount of alkaline material in an extraction vessel to effect extraction. Thus, pulp 102 is subjected to an aqueous alkaline solution for a predetermined time and at a predetermined temperature correlated to the quantity of alkaline material to solubilize a substantial portion of any lignin which remains in the pulp. This extraction process also increases the brightness of the pulp, typically by about 2 GE brightness points. Thereafter, the alkali treated pulp is directed to a washing unit, where the aqueous alkaline solution is washed from the pulp so as to remove substantially all of the solubilized lignin from the pulp, thus forming a substantially lignin-free pulp. This step is well known to those skilled in the art and no further comment is deemed necessary here. At least a portion of the alkaline solution which is recovered can be recycled countercurrently to other washing units. Again, major environmental benefits are achieved from the elimination of sewering of this solution.

5. Brightening or Subsequent Bleaching Stages

For most papermaking purposes, a final brightness in the range of 50 to 65 is unsatisfactory. Accordingly, in order to further raise the GE brightness to the more desirable range of about 70 to 90%, the pulp is subjected to brightening bleaching, which is primarily intended to convert the chromophoric groups on the lignin remaining in the pulp into a colorless state.

One of the principal materials which has heretofore been used, and which is generally highly effective, is chlorine dioxide (D) (see FIG. 1). In accordance with the invention, an appropriate amount of chlorine dioxide enables high-strength pulps having a GE brightness value greater than about 80% to be obtained. Since the pulps entering the chlorine dioxide stage are relatively low in lignin, the chlorine dioxide brightening bleaching can be carried out in the presence of only from about 0.25% to about 1% of chlorine dioxide based on the oven dry weight of the pulp.

The chlorine dioxide which is utilized in the brightening process should preferably be prepared by a process which is free from elemental chlorine. Alternatively, however, and less preferably, chlorine dioxide which does contain a minor amount of elemental chlorine can be used without any substantial increase in the relative amount of undesirable pollutants because of the relatively low amount of lignin present in the ozone-bleached pulp. The effluent from the final bleaching step of this invention when using chlorine dioxide is exceptionally low and can be discharged safely as shown in FIG. 1.

If sewering of the effluent from the final chlorine dioxide bleaching step is unacceptable, the stream can, however, be further purified by being treated with a membrane filtration process such as reverse osmosis. This technique provides a clean filtrate that can be recycled back to previous bleaching stages for further use. This has the benefit of reducing fresh water usage. Moreover, the concentrated chloride streams that result from the membrane filtration are relatively low in volume.

There may be some cases when extremely high pulp brightnesses are desired, for example, 92–95% GEB, where additional stages of bleaching may be required. An additional chlorine dioxide treatment would be a common choice, thereby creating a OmZmEDD bleach sequence. Alternatively, an additional extraction can be used in a OmZmEDED sequence.

Instead of using chlorine dioxide for final brightening, the brightening bleaching may be conducted with hydrogen peroxide, as also shown in FIG. 1. This technique provides a completely chlorine-free bleaching cycle (such as an $O_mZ_mEP$ sequence), wherein no chlorinated materials are formed in the bleaching process and the liquid extraction product can be readily recycled without the necessity for cumbersome filtration techniques. When utilizing peroxides as the bleaching agent, however, the K No. of the pulp from either softwood or hardwood should be reduced to a level of about 6 prior to the ozonation step in order to obtain, as a final product following the peroxide bleaching stage, a pulp of acceptable brightness, i.e., a GE Brightness of greater than about 80%, since peroxide is not as effective at bleaching as is chlorine dioxide. Where a completely chlorine/chlorine dioxide-free process is desired, however, peroxide provides acceptable results.

The consistency and pH of the pulp 102 exiting the ozone stage must be adjusted prior to carrying out the peroxide bleaching treatment. The consistency is thus raised to a preferred range of between about 10–15% while the pH of the pulp is adjusted upwardly to ensure a final pH of about 9.5–10.5. A peroxide stabilizing agent, selected from sodium silicate, magnesium sulfate, a chelate (such as EDTA or DTPA) or mixtures thereof, is added in an amount sufficient to prevent the undesirable decomposition of the hydrogen peroxide bleaching agent. The preferred stabilizing agent is a mixture of magnesium sulfate and sodium silicate. The stabilizing agents are added on a weight percent basis based upon the weight of the pulp, with preferred ranges of use being up to 3% of sodium silicate, up to 0.2% magnesium sulfate, i.e., as magnesium ($Mg^{++}$) and up to 0.2% of the chelate.

At this stage of the process, several different peroxide bleaching treatments may be selected with the particular one chosen depending on the GEB desired for the final product. In the first instance, a semi-bleached pulp having a final GEB of about 75 can be produced while along an alternative path, a final pulp product having a GEB of at least about 83–86 can be produced.

Where a bleached pulp having a final GEB of 83–86 is desired, an ozonated pulp with a GEB of 59–65 is contacted with at least about 0.9%, preferably from about 1–1.5% and most preferably about 1.1% by weight of a peroxide solution, preferably hydrogen peroxide, based upon the weight of the pulp. The reaction is permitted to continue in a bleaching tower for approximately three hours, with no further mixing of the pulp and peroxide once they are initially combined. The pulp must be at a GEB of at least about 59 prior to the peroxide bleaching stage in order to achieve a final GEB of at least 83.

If, however, the ultimate end use of the pulp produced by the process of the invention requires only a semi-bleached pulp having a final GEB of about 75, the process for forming GEB pulp of 83+ as described above may be modified by reducing the concentration of the peroxide bleaching agent by about ⅔, i.e., to between about 0.20%–0.65% and preferably about 0.4% by weight of the pulp. The pulp is placed in contact with this material (without additional mixing) for about three hours. In order to obtain optimum results with this procedure, the GEB of the ozonated pulp which serves as the starting material must be at least about 59.

In an alternate, but less preferred, process for forming 75 GEB pulp, pulp having an ozone GEB of about 65 is contacted with at least about 0.7% by weight of hydrogen peroxide for a truncated period of about 2–15 minutes, preferably about 5–7 minutes, in contrast to the three hour interval in the procedure described above, with continuous mixing. At levels of about 0.7 wt % and above of hydrogen peroxide, an increase of about ten points in GEB results from the ozone stage to the peroxide stage. Thus, the ozone stage GEB must be at least about 65 to permit the formation of a semi-bleached pulp of about 75 GEB.

In another method for forming 83+ GEB pulp, the preferred technique combines the truncated process described above (utilizing at least about 0.3% by weight of peroxide) to initially raise the GEB of the pulp by at least about 7 points, and preferably by about 10 points, i.e., to a GEB of about 70–75, followed by tower bleaching this bleached pulp for about three hours (with from about 0.6% by weight peroxide) so as to obtain a final product having a GEB of at least about 83. Thus, the truncated step may be utilized as an initial bleaching stage in the formation of 83+ GEB pulp. An important feature of this preferred process is that the effluent from the final peroxide bleaching stage (i.e., to 83 GEB) is recycled into the ozone delignified pulp prior to the initial bleaching stage. Thus, in the initial stage, not only is the pulp mixed with fresh peroxide, it is also continuously blended with the effluent from the final P-stage. Moreover, before the caustic (i.e., for pH adjustment) and peroxide are added in the final peroxide bleaching stage, the effluent of the initial stage is discharged.

Recycling the effluent from the final bleaching stage to the initial peroxide stage serves two purposes. First, residual peroxide in the bleaching effluent which is recycled may be consumed in the initial stage. Additionally, recycling the effluent to the initial stage helps to boost the ozone pulp brightness level prior to the final peroxide bleaching stage. As a result, the total amount of fresh hydrogen peroxide required in the bleaching operation is significantly reduced, thus providing an economic advantage tied to the use of the process. Peroxide levels in the effluent discharge are also significantly reduced.

Bleached pulp with a GE brightness of 83+ can also be produced from ozone delignified pulp with a GEB of 55+, i.e., in contrast to the 59+ GEB pulp used in the systems described above. To achieve this result, a Kraft-AQ/($O_m$ or $O_s$)/$Z_m$ pulp is subjected to two consecutive three hour peroxide bleaching treatments, each utilizing at least about 0.9% and preferably from about 1–1.5% of peroxide by weight, which increases the ceiling brightness by about 4 points and thus provide a sufficient bleaching action to raise the GEB of the pulp from 55+ to 83+. As in the systems described above, no extraction is carried out between the ozone and the peroxide stages. One requirement of using this technique, however, is that the pulp, upon exiting the oxygen delignification stage, must have a K No. of 9 or less and a viscosity of at least about 17 cps. This ensures that the pulp retains sufficient strength after oxygen delignification to permit it to withstand the effects of the modified ozone treatment carried out prior to the peroxide bleaching stage.

A preferred peroxide brightening stage is illustrated in FIG. 3. In one embodiment, 70–75 GEB semi-bleached pulp is obtained by passing ozonated pulp 102 through washer 106 to remove the by-products 108 of the ozone delignification reaction. The washed, ozonated pulp then enters reaction vessel 112 equipped with agitation means such as impeller 114, where it is combined with the hydrogen peroxide bleaching solution 116 for about 2–15, and preferably 5–7 minutes. Pulp 118 having, for example, a GEB of about 70–75 and an acceptable viscosity of at least about 9 cps, may be removed from reaction vessel 112.

In forming a final pulp product of GEB 83+ one may select, as a starting material, either: 1) ozonized pulp 102*a* or 2) partially bleached (i.e. GEB 70–75) pulp 120 from reaction vessel 112. The pulp (102*a* or 120) is treated with water 122 in (optional) washer 124. Effluent 126 from washer 124 may be recycled to washer 106 in order to conserve the peroxide bleaching agent. Washed pulp 128, having a GEB of about 70–75, is transported at a low consistency, i.e., about 10%, to reactor vessel 130.

In vessel 130, pulp 128 is contacted with the peroxide bleaching agent 132 for about three hours and bleached to a GEB of at least about 83. The consistency of bleached pulp 134 is thereafter raised to about 45% by, for example, pressing in a thickening unit such as twin roll press 136. A portion 138 of this pressate is recycled to reaction vessel 112 for use in the initial bleaching treatment as described above, thus significantly reducing the amount of fresh peroxide 116 which must be added. Finally, the high consistency bleached pulp 140 (GEB=83+) is washed with water 142 in washer 144 and the effluent 146 of that wash is discarded by sewering. Alternately, effluent 146 may be recycled for use in washer 124. The final pulp product 148, having an acceptable viscosity of at least about 9 cps and a GE brightness of at least about 83 may thereafter be collected for use.

Further details and examples of peroxide bleaching can be found in U.S. patent application Ser. No. 07/939,408, now abandoned, the content of which is expressly incorporated herein by reference thereto.

The washed, further brightened pulp has a GE brightness of between about 70 and 95% and preferably between about 80 and 95%. Also, the physical properties of this pulp are commensurate with those obtainable by pulp produced by conventional CEDED or OC/DED processes.

6. Washing Effluent Recycle

In any pulp process, filtrate management is an important factor in the overall economy or cost of operation of the process. The water which is used in the process requires both access to a suitable source and treatment of the effluent prior to discharge.

In an effort to reduce the water demand of the process, it is desirable to recycle as much of the effluent as possible. This practice cannot be used with processes utilizing chlorine or multiple steps of chlorine dioxide, since the effluents produced by these processes contain large amounts of chlorides produced by the by-products of such chemicals. Thus, recycling these effluents causes a build-up of chlorides which, in turn, causes either corrosion of processing equipment or the use of expensive materials of construction. In addition, such recycled effluents require substantial treatment before these effluents can be discharged from the mill, thus requiring further expenditures for equipment and treatment chemicals.

As illustrated in FIG. 4, use of either the conventional CEDED process or the OC/DED technique results in a significant disposal problem with regard to the effluents produced from the washing steps due to the high levels of chloride-containing compounds found therein. As noted above, these streams cannot be recycled, and are preferably treated before discharge into the environment. Recycling of effluent could be used to decrease the amount of water used, but then the process equipment may be subject to increased corrosion rates due to the increased chloride level in the recycled effluent.

In contrast, however, use of the OmZmED process of the invention results in formation of only a minimal amount of chlorinated material in the wash water, which water can be safely discharged, i.e., sewered, within most environmental protection standards. Alternately, this effluent may be treated by reverse osmosis to provide an even cleaner filtrate that may be recycled to previous bleaching stages as shown for further use without the build-up of chlorides. When a D bleaching stage is desired, steps may be taken to reduce the demand for chlorine dioxide. An $E_o$ step may allow the pulp to achieve greater levels of brightness although additional expense is incurred by the use of additional sodium hydroxide and oxygen in this step. Also, there are known industry procedures for preparing chlorine dioxide whereby residual chlorine levels are minimized (e.g., the R8 process vs. the R3 process). These reduced chlorine level chemicals are preferred for use in the D stage to reduce the chloride levels of the wash water effluent.

Instead of $O_mZ_m$ED one may use the $O_mZ_m$EP process of the invention to obtain additional substantial advantages over the prior art in that no chlorinated compounds whatsoever are produced. This enables all of the effluent to be recycled without experiencing the problems of chloride build-up in the process wash water streams.

Accordingly, the process of the present invention achieves substantial advantages with respect to reductions in effluent volume, color, COD, BOD and chlorinated organics. Moreover, since the effluent used in the washing steps contains significantly reduced chloride levels compared to prior art processes which utilize chlorine, the washing unit vents will not be carrying chlorinated organic compounds or gases which require treatment prior to discharge.

EXAMPLES

The scope of the invention is further described in connection with the following examples which are set forth for purposes of illustration only and which are not to be construed as limiting the scope of the invention in any manner. The examples appearing in U.S. Pat. No. 5,164,043 and applications Ser. No. 07/604,849, U.S. Pat. No. 5,181,989, as well as the other patents which are identified in the present specification, are adopted and incorporated by reference herein. All reported chemical percentages for these examples are calculated on the basis of the weight of oven dried (OD) fiber.

The following example reports on actual plant data utilizing a preferred embodiment of the inventive process.

Southern pine (softwood) was subjected to Kraft AQ pulping to form a pulp having a K No. of about 19–20 and a viscosity of at least about 23 cps. This pulp was washed and diluted to a consistency of about 3% in a mixing vessel with a solution of caustic (sodium hydroxide). The pulp and caustic solution were mixed for about 10–15 minutes and then forwarded to a press. The mixture was pressed to a pulp having a high consistency of about 27% by weight while retaining about 1.2% by weight of sodium hydroxide substantially uniformly distributed throughout. Thereafter, a second amount of about 1.2% by weight of sodium hydroxide was applied onto the high consistency pulp.

The pulp was then subjected to oxygen delignification at a pressure of about 80 psig oxygen at 110° C. for about 30–40 minutes. The resulting intermediate pulp had a lignin content evidenced by a K No. of less than about 14, and a strength evidenced by a viscosity of greater than about 9 cps.

Next, this intermediate pulp was washed, acidified and chelated. The consistency of the pulp was raised to about 40–42% by removing liquid from the pulp in a press. The pulp was comminuted in a fluffer and then subjected to ozone delignification in the paddle reactor disclosed in U.S. patent application Ser. No. 07/821,117. The reactor was operated at a dispersion index of about 2.5 with an ozone containing gaseous bleaching agent at a countercurrent gas flow to provide an amount of about 1% by weight of ozone on the pulp. The resulting ozone delignified pulp was found to have a lignin content evidenced by a K No. of about 6 or less, a strength evidenced by a viscosity of greater than about 7 cps and a GE brightness of about 35%.

The ozone delignified pulp was then washed and subjected to a conventional alkaline extraction (i.e., 1% sodium hydroxide on medium consistency pulp) followed by brightening with chlorine dioxide (about 1% on medium consistency pulp) to a final GE brightness of about 80–85. In the D stage, an R-3 type of chlorine dioxide solution, known to contain a 6:1 ratio of dioxide to elemental chlorine, was used.

It will be appreciated that numerous modifications and embodiments may be devised by those skilled in the art, and it is intended that the appended claims cover all such modifications and embodiments as fall within the true spirit and scope of the present invention.

What is claimed is:

1. A process for the manufacture of a bleached pulp having a certain GE brightness and a certain strength as indicated by a certain viscosity which comprises:

chemically digesting a lignocelluloeic material to initially form a pulp;

oxygen delignifying the pulp to remove a substantial portion of the lignin therefrom, with the combination of the digesting and oxygen delignifying steps being conducted to form an intermediate pulp. having a specified amount of lignin and a specified viscosity; and ozone delignifying the intermediate pulp with a gaseous mixture that contains ozone by adjusting the consistency of the pulp to a high consistency of above about 20%, adjusting the pH of the pulp to below about 4, and treating the pulp with an amount of the ozone containing gaseous mixture sufficient to remove a substantial portion, but not all, of the remaining lignin by intimately contacting and turbulently mixing the pulp particles with the gaseous mixture in a dynamic reaction zone by introducing the high consistency pulp into the reaction zone to fill the zone to at least about 10% by volume, dispersing the pulp substantially completely throughout the reaction zone while simultaneously conveying the pulp through the reaction zone in a plug flow-like manner at a dispersion index of about 7 or less thus exposing substantially all of the pulp to the ozone for reaction therewith for a sufficient time and at a temperature sufficient to allow access of the ozone to substantially all of the pulp for reaction therewith while the pulp advances through substantially all of the reaction zone, thus obtaining substantially uniform delignification of a significant portion of the pulp and forming a delignified pulp having a reduced amount of lignin and the certain strength, viscosity and GE brightness;

wherein the specified amount of lignin of the intermediate pulp is such that, after ozone delignification, the delignified pulp attains the certain GE brightness, and wherein the specified viscosity of the intermediate pulp is sufficiently high to permit the delignified pulp, after ozone delignification, to attain the certain strength as evidenced by the certain viscosity.

2. The process of claim 1 wherein the reaction zone is a horizontal chamber.

3. The process of claim 1 wherein the ozone delignification of the intermediate pulp is carried out by:

introducing the ozone containing gaseous mixture into the reaction zone for contact with the pulp; and intimately contacting and mixing the pulp with the ozone by lifting, displacing and tossing the pulp in a radial direction to disperse the pulp and expose substantially all of the pulp to the gaseous bleaching agent while advancing the dispersed pulp axially through the reactor in a plug-flow like manner and at said dispersion index for a predetermined time to obtain substantially uniform bleaching of the pulp and to form a bleached pulp having the certain GE brightness, certain strength and certain viscosity.

4. The process of claim 1 wherein the ozone delignifying step comprises:

increasing the consistency of said intermediate pulp to at least about 28%;

comminuting the increased consistency pulp into discrete particles of a predetermined particle size having a sufficiently small diameter and a sufficiently low density to facilitate substantially complete penetration of a majority of the pulp particles by ozone gas without causing significant degradation of the cellulose components of the pulp; and uniformly contacting said comminuted pulp particles and said ozone containing gaseous mixture during said turbulent mixing while the pulp is advanced through the reaction zone for a sufficient time to obtain substantially uniform delignification of a majority of the pulp particles.

5. The process of claim 1 which further comprises:

comminuting the pulp into pulp particles having a relatively low bulk density prior to introducing said pulp particles into the reaction zone; and maintaining a substantially constant and predetermined fill level of said pulp particles in the reaction zone by initially advancing said relatively low bulk density pulp particles at a first rate thus increasing the low bulk density, and advancing said increased bulk density particles at a second rate less than said first rate.

6. The process of claim 1 wherein the oxygen delignification step comprises forming a low to medium consistency pulp; treating the low to medium consistency pulp with an aqueous solution of an alkaline material for a predetermined time and at a predetermined temperature relative to the quantity of the alkaline material to substantially uniformly distribute the alkaline material throughout the low to medium consistency pulp; raising the consistency of the pulp to a high consistency; and subjecting the resulting high consistency pulp to high consistency oxygen delignification to obtain the intermediate pulp.

7. The process of claim 6 wherein the consistency of the pulp in the oxygen stage, prior to treatment with alkaline material, is reduced to less than about 5% by weight; at least some of the alkaline material is applied to the high consistency pulp; and at least a portion of the liquid removed from the consistency increasing step is directly recycled to the pulp treating step.

8. The process which further comprises:

oxygen delignifying the pulp by:

applying a first amount of alkaline material to brownstock pulp having a low consistency of less than about 5% by weight by combining the low consistency pulp with a sufficient quantity of alkaline material with uninterrupted mixing in a manner to ensure that all pulp fibers are exposed to the alkaline material to obtain a substantially uniform distribution of alkaline material throughout the pulp and then increasing the consistency of the alkaline material containing pulp to at least about 18% by weight to obtain high consistency pulp and to remove liquid while retaining the first amount of alkaline material substantially uniformly distributed throughout the high consistency pulp, said pulp fibers containing the alkaline material being directly passed from the combining step to the consistency increasing step;

applying a second amount of alkaline material onto the high consistency pulp to obtain a total amount of alkaline material on the pulp of at least about 0.8 to 7 percent by weight based on the oven dry weight of the pulp, wherein at least about 55% of the total amount of alkaline material is applied to the pulp during the alkaline material combining step; and subjecting the increased consistency alkaline material containing pulp to high consistency oxygen delignification to obtain enhanced delignification of the pulp without a corresponding decrease in pulp viscosity compared to pulp which is not combined with alkaline material at low consistencies and form an intermediate pulp having a specified amount of lignin and having a specified viscosity.

9. The process of claim 8 wherein the total amount of alkaline material is applied upon the low consistency pulp.

10. The process of claim 8 wherein the consistency of the pulp which is combined with the aqueous alkaline solution prior to oxygen delignification ranges between about 1 and 4.5% by weight, the consistency of the pulp is increased to at least about 25% by weight prior to the oxygen delignification step and recycing a significant portion of the removed liquid can be directly to the alkaline material combining step.

11. The process of claim 8 wherein, prior to the alkaline material combining step, the pulp has a consistency which is equal to or greater than that of the high consistency pulp which is to be formed so that substantially all removed liquid can be directly recycled to the alkaline material combining step.

12. The process of claim 8 which further comprises adjusting the pH of the pulp to a range of about 1 to 4 by adding to the pulp a sufficient quantity of an acidic material prior to ozone delignification and increasing the consistency of the pulp to at least about 20% by weight prior to ozone delignification.

13. The process of claim 12 wherein the ozone delignification step comprises acidifying the pulp and treating the acidified pulp with a gaseous mixture containing ozone in an amount sufficient to remove a substantial portion, but not all, of the lignin remaining in the pulp by intimately contacting and turbulently mixing the pulp with the ozone containing gaseous mixture in a dynamic reaction zone for a sufficient time and at a temperature sufficient to allow access of the ozone to substantially all of the pulp for reaction therewith while advancing the pulp through the reaction zone to obtain a substantially uniformly delignified pulp having said certain strength, viscosity and GE brightness.

14. The process of claim 8 wherein the pulp is unbleached softwood pulp and the amount of alkaline material applied to said pulp is between about 1.5 and 4 percent by weight.

15. The process of claim 8 wherein the pulp is unbleached hardwood pulp and the amount of alkaline material applied to said pulp is between about 1 and 3.8 percent by weight.

16. The process of claim 1 wherein the intermediate pulp has a K No. of about 14 or less and a viscosity of greater than about 10 cps; the delignified pulp has a K No. of about 6 or less, a viscosity of greater than about 7 cps and a GE brightness of at least about 35%; and the intermediate pulp is directed to ozone delignification without any intervening delignification or bleaching steps.

17. The process of claim 16 wherein the lignocellulosic material is a softwood and, after the oxygen step, the K No. is about 11 or less and the viscosity is greater than about 12 cps, while after the ozone step, the K No. is about 5 or less, the viscosity is greater than about 9 cps and the GE brightness is at least about 45%.

18. The process of claim 16 wherein the lignocellulosic material is a hardwood and, after the oxygen step, the K No. is about 9 or less and the viscosity is greater than about 12 cps, while after the ozone step, the K No. is about 5 or less, the viscosity is greater than about 9 cps and the GE brightness is at least about 55%.

19. The process of claim 1 which further comprises bleaching the delignified pulp after ozone delignification with a brightening agent to further increase the GE brightness of the pulp.

20. The process of claim 19 which further comprises combining the delignified pulp with an effective amount of alkaline material in an alkaline aqueous solution at a predetermined temperature, correlated to the amount of alkaline material combined, to solubilize a substantial portion of any lignin remaining in the bleached pulp; and thereafter extracting a portion of the aqueous alkaline solution so as to remove substantially all of the solubilized lignin therefrom and form an extracted pulp.

21. The process of claim 19 wherein the brightening agent is a peroxide compound and which further comprises contacting said pulp with a sufficient amount of the peroxide compound with continuous mixing to raise the GE brightness thereof to at least about 75.

22. The process of claim 19 wherein the brightening agent is chlorine dioxide having a reduced amount of residual chlorine content and which further comprises contacting said pulp with a sufficient amount of the chlorine dioxide compound to raise the GE brightness thereof to at least about 80.

* * * * *

UNITED STATES PATENT AND TRADEMARK OFFICE

CERTIFICATE OF CORRECTION

PATENT NO. : 5,409,570

DATED : April 25, 1995

INVENTOR(S) : Bruce F. Griggs, Thomas P. Gandek, Michael A. Pikulin, Allen Rosen, Stuart T. Terrett, Spencer W. Eachus, David E. White, William H. Friend, and Omar F. Ali It is certified that error appears in the above-indentified patent and that said Letters Patent is hereby corrected as shown below:

In Claim 8, Column 30 at line 62, after "process" insert – of claim 1 –.

Signed and Sealed this

Twenty-ninth Day of August, 1995

*Attest:*

Bruce Lehman

BRUCE LEHMAN

*Attesting Officer*

*Commissioner of Patents and Trademarks*